United States Patent [19]

Fulton et al.

[11] 3,979,033

[45] Sept. 7, 1976

[54] AUTOMATIC PISTON POURING EQUIPMENT

[75] Inventors: Robert J. Fulton, Mississauga; Neil S. Calvert, Toronto; Joseph W. Valler, Downsview, all of Canada

[73] Assignee: Chrysler Corporation, Highland Park, Mich.

[22] Filed: Sept. 29, 1972

[21] Appl. No.: 293,712

[52] U.S. Cl. ..... 222/604; 164/336

[51] Int. Cl.[2] ..... B22D 41/04; B22D 41/06

[58] Field of Search ..... 164/136, 155, 335, 336; 222/DIG. 8, DIG. 15, 16, 166, 63, 604, 70

[56] References Cited

UNITED STATES PATENTS

| | | | |
|---|---|---|---|
| 2,882,567 | 4/1959 | Deakius et al. | 164/155 |
| 3,056,179 | 10/1962 | Lovang | 222/63 |
| 3,415,421 | 12/1968 | Britcher, Jr. | 222/166 |

*Primary Examiner*—Robert B. Reeves
*Assistant Examiner*—David A. Scherbel
*Attorney, Agent, or Firm*—Talburtt & Baldwin

[57] ABSTRACT

An automated ladle, based on a swinging arm concept for pouring piston castings. The ladle carried at the end of the arm, is tilted in a controlled and programmed manner to a "pour position" by means of a cam switch operated motor drive which rotates the swinging arm about its longitudinal axis to effect pouring. Electrical circuitry interconnects the ladle mechanism with a molten metal holding furnace and a pair of automated piston molding machines for automatically controlling the operation of the entire assembly.

14 Claims, 22 Drawing Figures

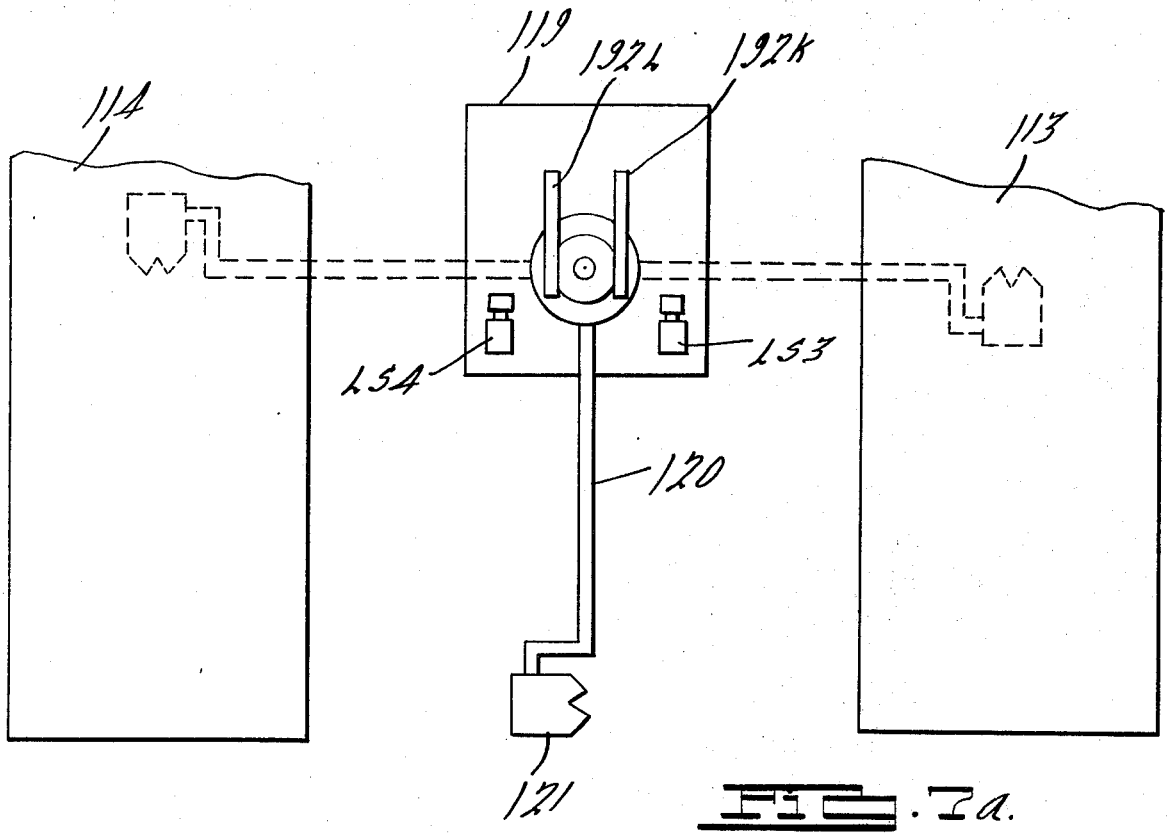
FIG. 7a.
FIG. 7b.
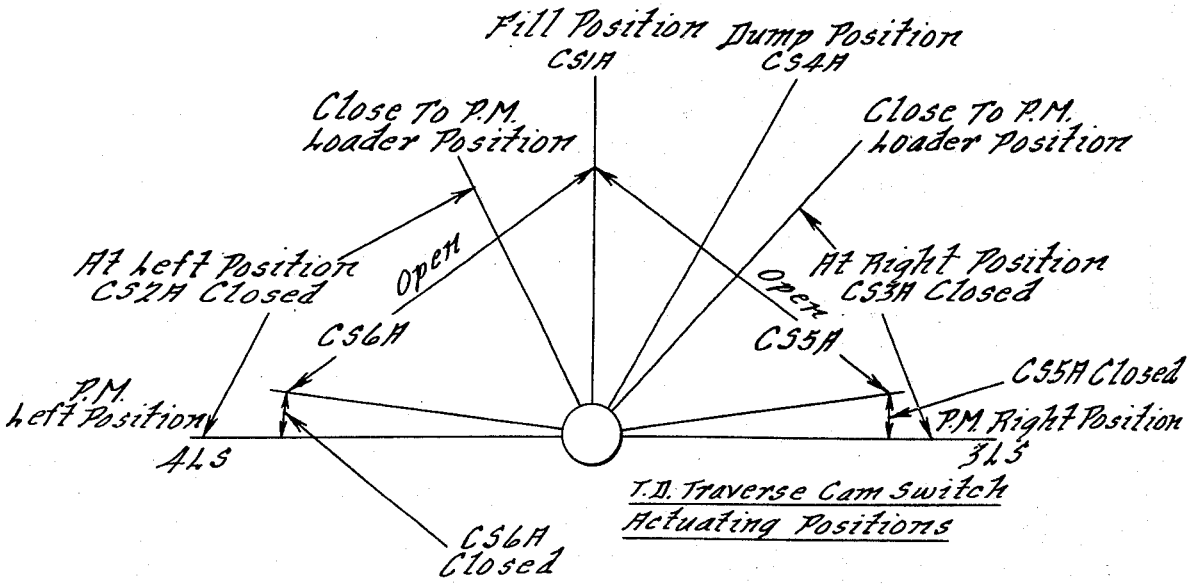

Power On
Shutdown
Emerg. Shutdown
3,4,5
Audible Alarm
Fill Position
2, 37, 52, 60, 69, 74, 91
T.D. Hf PM Left Position
53, 56, 95, 96A
T.D. In PM Left Position 50G.
21, 41, 70, 111, 58, 61, 62, 50B, 94A
T.D. Hf PM Right Position
54, 59, 114, 115,
T.D. In PM Right Position 50H
22, 42, 72, 130, 81, 52, 55, 50C, 113A
T.D. In "Auto" Dump Position
23, 67
T.D. In "Hand" Dump Position
51, 62
Ladle Horizontal
26, 37, 48, 74, 54, 60, 54
Ladle Vertical
24, 26, 31, 40, 43, 74, 110, 129
110V Supply
Shutdown Reset
Audible Alarm
Off On
Master Stop Power
Delayed Open
E.S.R.

Fast Pot. Setting Approx. 70-80
Slow Pot. Setting Approx. 40-50
Left
Fast Return
Right
92 Skim Catcher
91 Skim Catcher Sol.
Del. Close
Boston Ratiotrol-Ladle Turn Control
Ratiotrol
Contactor Unit Speed
1st. Pot. Setting Approx. 40-60
2nd. Pot. Setting Approx. 10-20
3rd. Pot. Setting 100
Reverse Pot. Setting 100
Ladle Down
Ladle Up CSA = Cam Switch-Traverse
CSB = Cam Switch-Ladle Turn LS1 Ladle Up
LS2 Ladle Down
LS3 T.D. In Left Position
LS4 T.D. In Right Position
LS5 Skim Catcher Fully Back CS5A-Operates 2nd. Speed At Right Position
CS6A-Operates 2nd. Speed At Left Position Notes:
(1) Adjust To Open When Ladle Is Back In Fill Position

AUTOMATIC PISTON POURING EQUIPMENT

BACKGROUND OF THE INVENTION

This invention relates generally to apparatus for the automatic or automated casting of articles. The invention can be used in casting or pouring a wide variety of items both as to type and as to material. An exemplary application of the invention is in the casting of aluminum pistons for internal combustion engines. A primary object of the invention is to provide reliable automated pouring ladle equipment having improved simplified construction and operation over prior pouring approaches. Another object of the invention is to provide the necessary interfacing or interlocking control means for use with known automated equipment such as metal holding furnaces and automatic molding machines. It is also an object of this invention to provide automated pouring equipment which is compatible with current space requirements for production piston molding facilities.

Most of the pistons cast in the automotive industry today are cast manually. Certain problems exist in the manual pouring of pistons which make automated pouring means desirable. The quality of permanent mold pistons produced by manual pouring is controlled to a major extent by human elements. This fact is obvious to those familiar with this art since they know that there are differences in quality and productivity between individual pourers even though extensive mechanical factors have been provided to assist the pourer in his task.

In general, various expedients have been used at one time or another in an attempt to obtain low scrap and high production rates, such as temperature and metallurgical control of the metal; closely timed cooling cycle of the poured metal; closely controlled mold dimensions; temperature and flow rate control of the mold cooling system and the cooling water, and scale formation prevention in the water cooling system for the mold. All of these expedients are based on the belief that metal of the same composition, poured at the same temperature, and in the same manner, into molds of the same shape and under the same cooling conditions, will produce the same finished product each time. Furthermore, if these conditions are correctly set, it is believed that the quality of the product will be uniformly high and more satisfactory for use.

In spite of all of the controls of the type listed above which have been used, scrap still occurs erratically and on a continuing basis. The majority of this scrap can be traced to one factor which is completely variable, that is the man pouring the metal. Well trained and conscientious operators can produce a good product with very little scrap attributable to pouring per se. However, the job is hot and arduous and a relatively high labor turn-over exists. New men in training and other human factors tend to produce scrap and low productivity.

The major operator attributable scrap causes are: mis-runs, flash, trapped gas and inclusions.

Mis-runs are caused by metal not running into areas of the mold which it should normally fill. This can occur because metal traveling to the area in question freezes before that particular mold cavity area can be completely filled with molten metal.

Three main human factors appear to be active in this regard. The transfer of metal from the furnace to the mold slowly causes the operator to start his pour with colder metal than a faster transferring operator. Pouring the transferred metal at slow rates delivers cooler metal into the mold cavity areas than pouring at faster rates. Also pouring fewer pistons per hour causes operation with cooler molds than producing at a faster rate.

Flash is the reverse of mis-runs. It is caused by metal running into mold joints where it is not desired and where it forms thin pieces of excess metal. It is less common as an operator fault than mis-runs since the main human factor which produce it are less frequently encountered.

Again, three primary human factors appear to be operative in causing flash. Fast transfer from the furnace to the mold results in hotter metal than is necessary for a good cast article. Faster pouring rates provide hotter metal with greater kinetic energy in the mold joint area. Also, faster production rates result in hotter molds.

Entrapped gas results when metal is poured into a mold in an erratic or turbulent manner so that air is trapped in the entering stream of molten metal causing the formation of large voids in the casting. The gas entrapped in the molten metal stream does not break out from the molten metal at a mold/metal surface for two main reasons. Firstly, the inside of the void becomes oxidized as soon as the air is entrapped and metal outside acts as an envelope to contain the gas. Secondly, the solidification is very rapid in the mold and the metal freezes before the entrapped gas can break out of the surface.

Inclusions of metal oxide, refractory particles and the like usually occur when a operator does not skim back the surface of the metal in the furnace before dipping to fill the ladle or when he uses a dirty ladle which contains metal oxide in the form of a skin which lines the ladle from the last pour.

From the above it can be seen that a mechanical, preferably automatic, means for transferring metal from a molten metal holding furnace or the like to a mold should be expected to provide a considerable increase in quality and productivity. However, such a means must overcome the problems associated with molten metal as discussed hereinabove. Attempts to mechanize the pouring process have been previously made. However, at present major permanent mold piston producers continue to hand pour the metal into the molds when manufacturing pistons.

Experience indicates that the following requirements are absolutely necessary for a successful mechanical pouring apparatus. The machine must be rugged. Smooth action is imperative. The action must be fast but well controlled. There should be buffering at the end of machine movements, i.e., there should be no abrupt starting or stopping which tends to wash metal about in the ladle or spill it. The action must be positive in that its movements are reproducible and are all carried out in the same place each time they are repeated.

The following observations have been made in connection with the techniques used by the best hand pourers of pistons. These pourers do not rotate the ladle about its approximate center of gravity but rotate it about a horizontal axis across or normal to the tip of the ladle pouring spout. To start the pour the spout is placed as close into the sprue opening of the mold as possible to minimize the free fall into the mold and the turbulence generated during the pour. A good operator pours rapidly at the immediate start of the pour then appears to reduce the rate of metal delivery somewhat until close to the end of the pour when metal appears at the base of the riser. At this point he tends to raise the ladle somewhat and increase the rate of pour until the riser is full when he cuts off the flow of metal completely.

It is speculated that the fast start with a minimum free fall is necessary to establish fast filling of the lower parts of the mold at a time when these portions of the mold are at their coldest in the casting cycle. Fast pouring at this stage ensures that metal reaches the remote cold parts of the mold. Once flow has been established it is desirable to slow down the rate of pour so that metal fills the mold layer upon layer with the hottest metal always being the highest layer in the mold. Thus, feeding the cooler areas of the mold, which are solidifying and contracting, occurs the hot metal flowing down from the higher areas. The end of this stage of the pouring operation occurs when the cavity has been filled completely and the next task is to fill the riser of the mold. The function of the riser is to act as a reservoir of molten metal to be drawn into the cooler areas of the mold as the metal solidifies and to compensate for the solidification shrinkage which takes place. It is thus an ideal situation that the riser be filled with the hottest metal possible. By increasing the rate of flow from the ladle and sometimes even raising the spout slightly the metal runs into the sprue more quickly and with a higher kinetic energy. This combination ensures that the last metal poured moves rapidly through the sprue and into the riser to give the hottest possible metal in the riser area.

SUMMARY OF THE INVENTION

Apparatus of this invention comprises a swinging arm having a ladle mounted on the end thereof, hereinafter referred to as the "transfer device" or "T.D.", similar in its general aspects to the device disclosed in copending application Ser. No. 188,056 and assigned to the same assignee as the instant application. The subject invention constitutes an improved version of the earlier device in that, among other things, the arm is coupled to a gearbox which is rotated by a variable speed electric motor so as to rotate the arm about its longitudinal axis in a predetermined manner. This action tilts the ladle so that molten metal pours therefrom in a repeatable fashion. The speed of the electric drive motor is programmed to provide a pour suitable for the particular mold. Accordingly, the drive may cause fast pouring at one point or points in the pour and slower pouring at others, as desired.

In an automated form, with such a transfer device in a "start" or "fill" position, the ladle is located under the pouring spout of a molten metal holding and dispensing means and is filled with a measured or metered amount of molten metal. The dispensing means provides a signal that the metered amount of molten metal has been placed in the ladle and a mold apparatus such as an automatic piston molding machine, which is sometimes referred to hereinafter simply as "P.M.", provides a signal that it is ready to receive the molten metal into its mold. Upon receipt of these signals the transfer device swings the ladle into its pouring position above the mold. The arm may be swung by any suitable rotary mechanism preferably of an electrical type, although a hydraulic arrangement may be used. A preferred variable speed electric motor drive arrangement is described hereinbelow. In the pouring position a stop is contacted to actuate a limit switch which issues a signal that the arm and ladle have reached the pouring position. Also, preferably, a "positioner" means will be arranged so that arm may rest against it when the ladle is positioned above the mold, a pin and clevis positioner arrangement being preferred, as is described hereinbelow. A second signal is preferably necessary before pouring the molten metal from the ladle. This is a signal from the molding machine that the molds are ready to receive molten metal. Upon receipt of these signals the swinging arm is rotated about its longitudinal axis by rotation of the electric drive motor, tilting the ladle in a programmed manner and pouring the molten metal into the mold. A cam switch is set to actuate further steps in the machine cycle when the ladle has reached the position where all the molten metal has been poured. At this point the swinging arm starts its return to the "fill" position while the ladle tilting mechanism returns the ladle to its horizontal position. Upon reaching the "fill" position the switch is actuated thus stopping the movement of the rotating arm. The ladle remains in this position until another signal is obtained from the mold or from a second mold that the casting has been removed therefrom and pouring can again be commenced. At this point the cycle is initiated again. An abort means is preferably included in case the mold cannot for some reason receive the molten metal. In such a situation the ladle is moved to a position where the metal is poured into an ingot mold or the like.

BRIEF DESCRIPTION OF THE DRAWINGS

FIGS. 7*a*, 7*b* and 8 are schematic plan views similar to FIGS. 4 through 6 showing the arrangement of some of the various control switches (both cam and limit) for controlling various traversing portions of the automatic cycling of the pouring ladle.

FIGS. 13 and 14 are electrical schematics showing the electrical terminal portions of two piston molding machines placed to either side of the automatic pouring ladle apparatus and also showing the various control relays which interconnect the piston molding machines to the automatic pouring ladle for the automated control of the entire molding operation from the filling of the pouring ladle to the pouring of the molten metal into the molds and the unloading of the cast pistons therefrom by the automatic piston molding machine.

DESCRIPTION OF THE PREFERRED EMBODIMENTS

Figure 4:
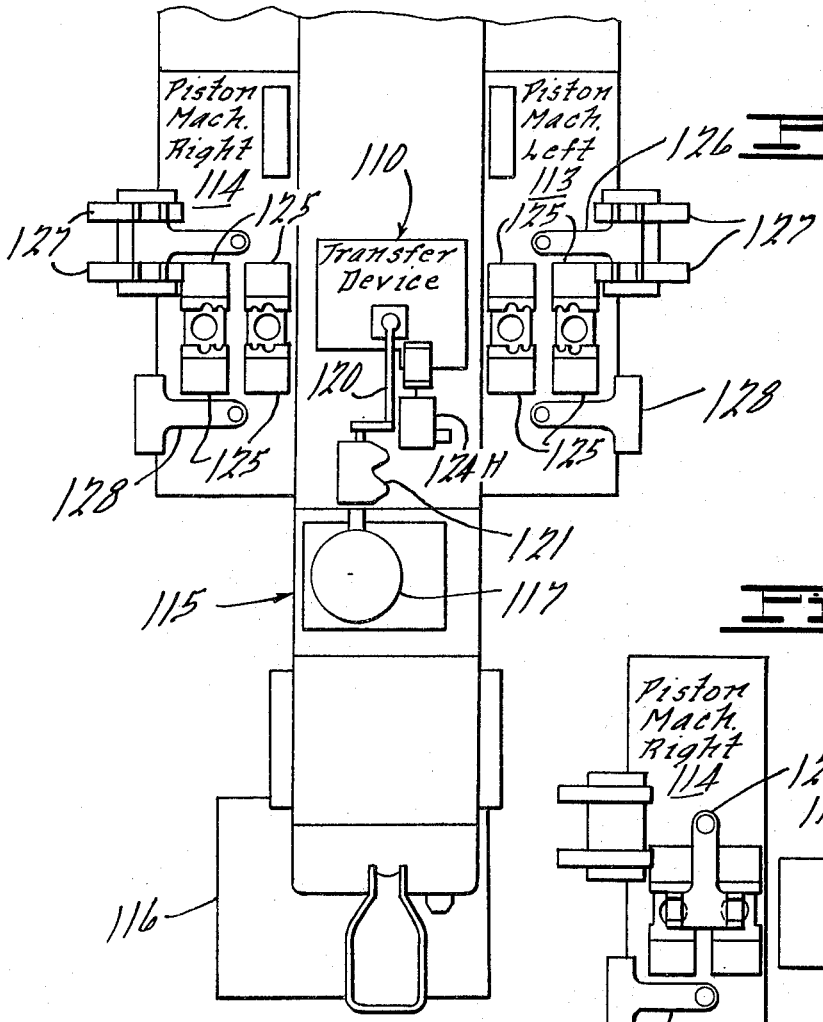
FIG. 4 is a schematic plan view of an apparatus according to the invention showing its general arrangement relative to a pair of automatic piston molding machines and a metal holding furnace, the automatic pouring ladle being shown in the "fill" position.

Shown in the drawings, FIGS. 1 through 11 in particular, is a piston casting installation comprised of an automatic piston pouring ladle apparatus or transfer device according to the invention, generally designated at 110, which is positioned between a pair of automatic piston molding machines generally designated at 113 and 114, respectively, also sometimes referred to hereinafter as P.M. left and P.M. right, respectively. The molding machines per se do not form any part of this invention and may be of the type disclosed in U.S. Pat. No. 2,965,938 which issued on Dec. 27, 1960. These machines are shown for illustrative purposes and only so much of them as is necessary will be described herein in connection with the present invention. It will be apparent to those familiar with this art that other kinds of molding equipment may be used in their place. An electrically controlled automatic version of the molding machines described in the above-mentioned patent is commercially available and will be briefly described in connection with the automatic pouring ladle apparatus of the present invention as illustrative of a completely automatic piston casting installation. The other basic component of the casting installation is shown in FIG. 4 at 115 and consists of a molten metal holding means indicated by 116 and a dispensing or metering means 117 for metering measured amounts of molten metal into the automatic pouring ladle apparatus 110. Metering means 117 may, for example, take the form of a device known as an AUTOLADLE which is marketed by the Lindberg-Hevi-Duty Division of Sola Basic Industries of Watertown, Wisconsin. Such a unit consists essentially of a self contained crucible assembly which is immersed in a suitable sized furnace chamber filled with molten metal. A refractory delivery tube is connected to the bottom of the special crucible and extends to the outer furnace shell above the furnace metal level. Since the crucible and delivery tube are submerged within the molten metal, the temperature of the liquid metal within the crucible and delivery tube is constantly maintained at proper temperature by the molten metal itself. Automatic valving may be arranged for dispensing molten metal by controlling the flow of molten metal through the delivery to the automatic pouring ladle apparatus 110. This unit is disclosed more specifically in U.S. Pat. No. 2,846,740 and does not form a part of the present invention per se. Therefore, only so much of it as is necessary is described herein and further details concerning it may be obtained from the reference patent.

As will be described in detail hereinbelow, the action of the transfer device 110 forms part of a piston casting cycle which is accomplished automatically in conjunction with the operation of the piston molding machines and the metering of molten metal into ladle 121 from the metal holding unit 115.

The automatic ladle pouring apparatus or transfer device 110 comprises traverse drive unit 119 comprising a variable speed D.C. motor 119*a*, gear reduction mechanism 119*b*, a rotary cam switch assembly 119*c* for controlling motor 119*a* and a vertical drive axis 119*d* for rotating a swinging arm 120 and its accompanying mechanism. Traverse Drive Unit 119 may consist of, for example, a Boston Ratiomotor D.C. electric drive VE series driving through a Boston gear reductor 300 series made by the Boston Gear Division of North American Rockwell Corporation. The unit is actuated to swing transfer device 110 from the position shown in FIGS. 1 and 4, the "fill" position, to either of the piston machines 113 or 114 in a rotary motion, the speed of which is controlled by rotary cam switch assembly 119*c* in a predetermined or programmed fashion.

For example, cam switch assembly 119*c* as shown comprises a TM Series Modular Timer adapted to operate speed controlling preset potentiometers in a control circuit available as a Ratiotrol Unit with the Boston Ratiomotor. The Modular Timer is available from Eagle Signal, a systems division of Gulf and Western Industries, Inc. and is fully described in their Bulletin 345 TIME/MODULE TM SERIES.

Figures 1, 2, 3:
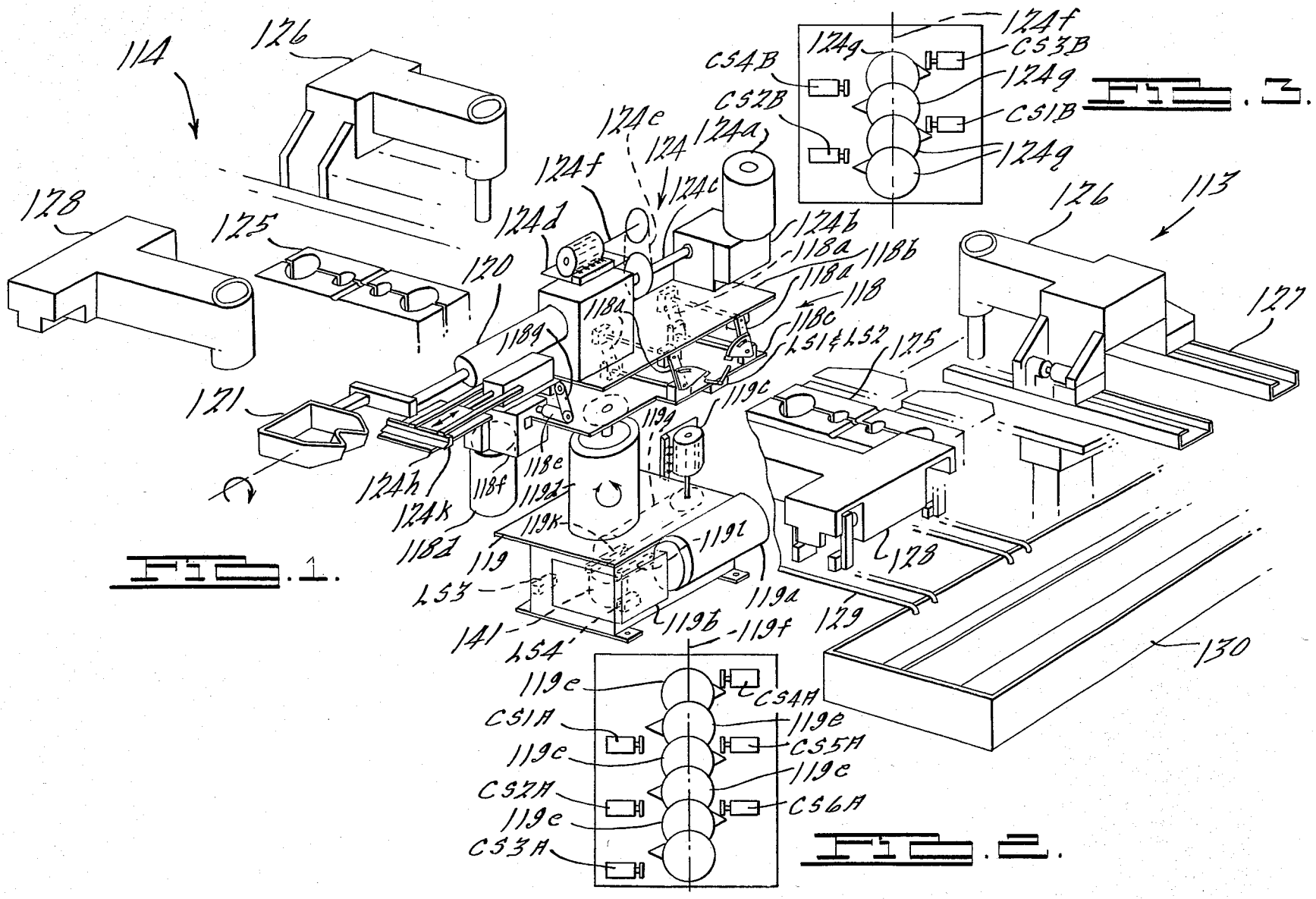
FIG. 1 is a pictorial schematic illustrating the basic mechanical components of a ladle pouring apparatus according to the invention and its position relative to a pair of piston molds of an automatic type.
FIG. 2 is a schematic showing of a rotary cam switch assembly for controlling the movement of the ladle apparatus between the dispensing means and the molds.
FIG. 3 is a schematic showing of a rotary cam switch assembly for controlling the pouring motion of the ladle.

The timer, as adapted for the purposes herein described and shown in FIGS. 1 and 2, include a number of normally open cam operated switches, in this particular case there are six, CS1A, CS2A, CS3A, CS4A, CS5A, and CS6A along with six corresponding rotary cams 119*e* carried on and rotated by a shaft 119*f*. The rotating cams are arranged on shaft 119f to close the switches at preselected or programmed time intervals during rotation of shaft 119*f* by means of chain drive 119*g* which rotates shaft 119*f* when motor 119*a* causes vertical axis 119*d* to rotate. With such an arrangement, rotation of transfer device 110 on its vertical axis 119*d* causes the programmed actuation of switches CS1A through CS6A, this results in modifications of motor speed and controls the traversing speed of the transfer device. Rotation in one direction actuates CS1A, CS2A, CS6A while the reverse direction causes actuation of CS1A, CS3A, CS5A, or CS4A.

In this instance, the following arrangement is provided (also refer to FIG. 7*b*):

TABLE

| | CAM SWITCHES - TRAVERSE |
|---|---|
| No. CS1A | Closes when ladle is in fill position. |
| No. CS2A | Closes when ladle approaches P.M. Left. |
| No. CS3A | Closes when ladle approaches P.M. Right. |
| No. CS4A | Closes when ladle is in dump position. |
| No. CS5A | Initiates second traverse speed at right position. |
| No. CS6A | Initiates second traverse speed at left position. |

Two limit switch actuator arms 119K and 119L are carried on opposite sides of vertical axis 119*d* so as to actuate limit switch LS3 when the tranfer device rotates in one direction and LS4 when in the other direction. Below these arms is a pneumatic brake of a commercially available type which is used to stop rotation of the transfer device at selected positions.

Swinging arm 120 terminates in a ladle 121 at one end and a tilting or pouring mechanism 124 at the other end. Mechanism 124 includes a variable drive DC motor 124*a* such as a Boston Ratiomotor D.C. Electric Drive VE Series which drives through gear reducer 124*b*, such as a Boston Gear reductor 300 Series made by the Boston Gear Division of North American Rockwell Corporation, and which is coupled to rotate swinging arm 120 by shaft 124*c*. The mechanism also includes a rotary cam switch assembly 124*d*, appropriately mounted relative to shafts 120 and 124*c* so as to be connected, as shown in FIG. 1, thereto by a drive chain 124*e* so that rotation of shaft 124*c* causes rotation not only of arm 120 but the shaft 124*f* of cam switch assembly 124*d* as well.

Cam switch assembly 124*d* is also shown in FIG. 3 and is basically the same as the lower cam switch assembly 119*c* used in traverse drive 119. Assembly 124*d* includes four normally open switches CS1B, CS2B, CS3B and CS4B along with four corresponding rotary cams 124*g*, which are carried on and rotated by shaft 124*f* so as to close the switches at preselected or programmed time intervals during rotation of shaft 124*c* by motor 124*a*. The switches are connected to relays and potentiometers in a motor control circuit to modify and control the speed of motor 124*a* and thus to cause ladle 121 to pour in a controlled predetermined manner. The cam surfaces of each switch may be arranged in any manner desired to provide for duration of switch closing.

In accordance with studies in conjunction with the present invention and as indicated hereinabove, it was determined that controlled, variable pouring rates are desirable in pouring pistons for automobile engines and other items as well. The pouring rate for automobile pistons is preferably initially fast to establish flow, then slow until the end of pour, then fast to dump dross.

In this instance the following program is desirable:

TABLE

| | CAM SWITCH - LADLE POUR |
|---|---|
| No. CS1B | Closes when ladle is in the horizontal position. |
| No. CS2B | Closes when ladle is in the vertical position. |
| No. CS3B | Closes when ladle reaches proper tilt angle and initiates slow pour speed. |
| No. CS4B | Closes when ladle has poured all molten metal. Closing action initiates speed increase which dumps skim from ladle. |

It has been determined that this specific arrangement for accomplishing tilting of the ladle by rotating the swinging arm about its longitudinal axis makes possible the improved smooth pouring at variable pour rates which is necessary and critical to the successful automated pouring of molten metal to closely simulate the pouring motions of manual operators.

The swinging arm mechanism also includes an arrangement for collecting excess or hardened dross metal following ladle pouring. After completion of the pouring of the molten metal a suitably shaped plate 124*h* is automatically positioned under the ladle 121 in order to catch the dross which falls from ladle 121 after the molten metal has been poured. The dross remains on plate 124*h* until ladle 121 has been returned to the fill position. At the fill position, the plate is cleared of dross by its retraction under the scraper 124*k* when the plate is repositioned for the next pour. The plate is reciprocated by air cylinder 124L.

To enable ladle 121 to be laterally and vertically positioned in the optimum pouring position at the molds a linkage system 118 connects arm 120 and related mechanism to traverse drive unit 119. Linkage system 118 comprises pivotally mounted parallel arms 118*a* which interconnect, by means of a suitable arrangement such as that shown, an upper table 118*b* to a lower table 118*c*. The linkage system is actuated by an electric motor 118*d* driving an output shaft 118*e* through a gear box 118*f*. Output shaft 118*e* operates an arm 118*g* which raises and lowers upper table 118*b* relative to lower table 118*c* depending on which direction the shaft is rotated. This action not only effects raising and lowering of ladle 121 but also moves it laterally inwardly and outwardly relative to vertical axis 119*d*. A suitable limit switch actuator means 119*h* is carried on two of the arms 118*a* as shown to actuate normally open limit switches LS1 and LS2 depending on whether the table is being raised or lowered.

Each of the piston mold machines PM Left and PM Right include two centrally disposed substantially identical sets of sectional molds 125 (shown in the closed position) which may be opened and closed by suitable hydraulically actuated means (not shown) which move the mold sections toward and away from each other for assembling the components to form a mold cavity and for disassembling the components to expose an article which has been cast in the cavity. Supported at one side of molds 125 is a strut loader 126 (shown in the out and up positions) which can be raised, lowered and rotated for transferring piston reinforcing elements or struts from a strut magazine 127 to molds 125 so that the reinforcing struts may be embedded in the piston which is to be cast in the mold cavity. The function of a strut is to control the thermal expansion of the piston in the automobile engine. Supported on the other side of molds 125 is a piston unloader 128 (shown in the out and down positions) which can be raised, lowered and rotated for engaging pistons, which have been cast in the molds, and carrying them to a cooling location such as a rack 129 at one side of the machine from which the pistons may be moved to a conveyor belt such as that indicated at 130.

FIG. 4 illustrates ladle 121 in the "fill" position and the piston molds 125 on the two piston machines PM Left and PM Right in the "open" and "ready" condition, that is, ready to receive a charge of molten metal from ladle 121. With ladle 121 in the "fill" position, a measured or metered amount of molten metal is released from unit 117 into the ladle.

Figure 5:
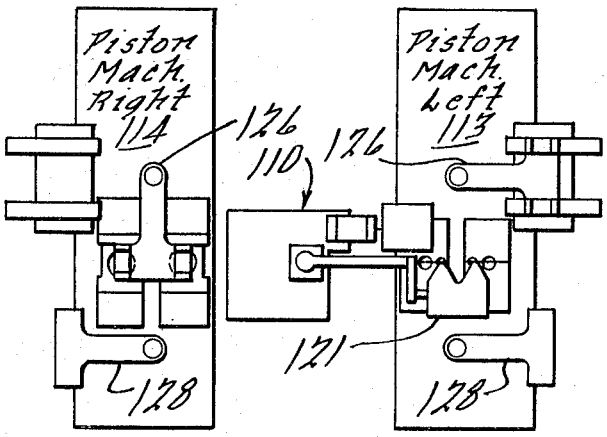
FIGS. 5 and 6 are generally similar schematic plan views showing the automatic pouring ladle in the "pouring" position at each of the automatic molding machines.

FIG. 5 shows ladle 121, containing metal, moved into a pouring position over piston machine PM Right, the molds are closed and ready to receive a charge of molten metal. Unloader arm 128 on piston machine PM Left is shown in the act of removing castings from the open molds of that machine.

Figure 6:
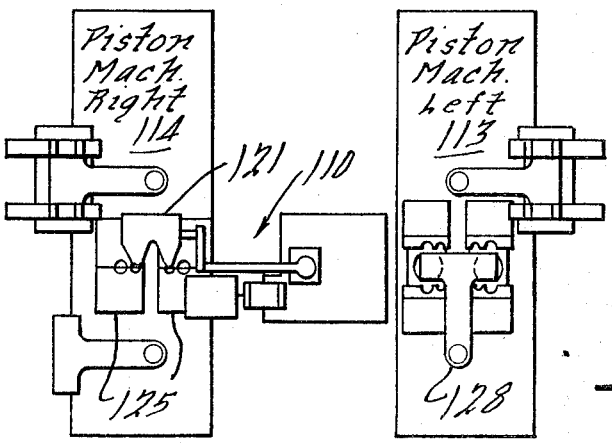

In FIG. 6 ladle 121 has poured molds on machine PM Right, moved back to the "fill" position as illustrated in FIG. 2 and has moved to the "pour" position on machine PM Left. Struts are shown being placed in the mold of machine PM Right and the castings which were poured in FIG. 5 are now on unloader arm 128 and in the "discharge" position.

Figure 8:
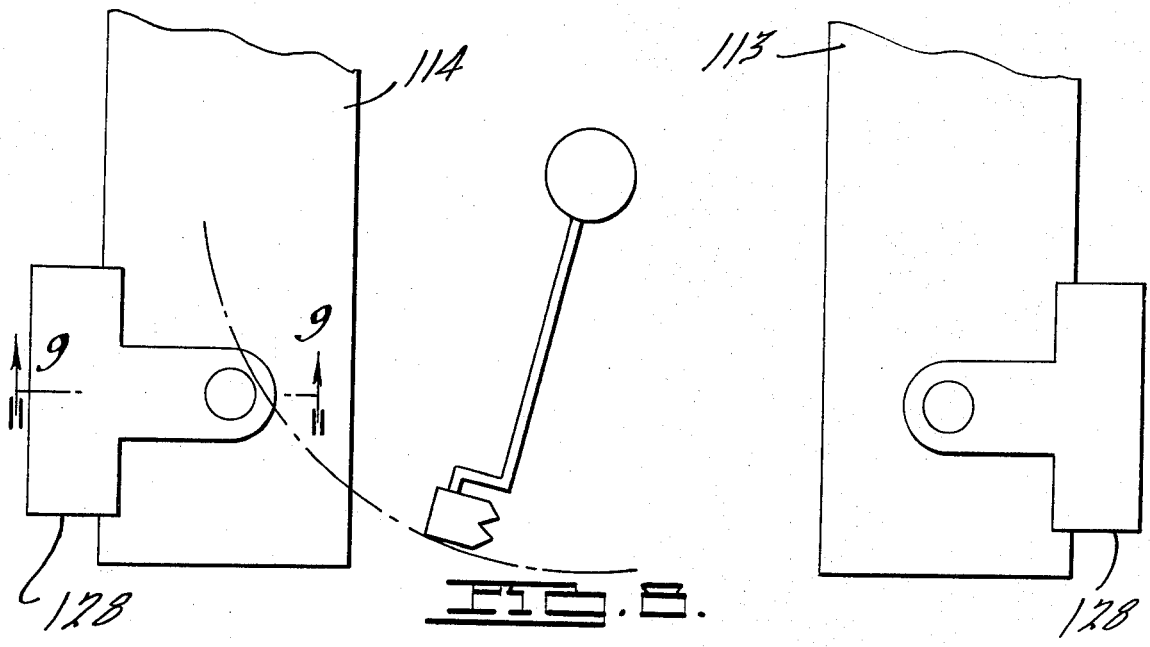
Figure 9:
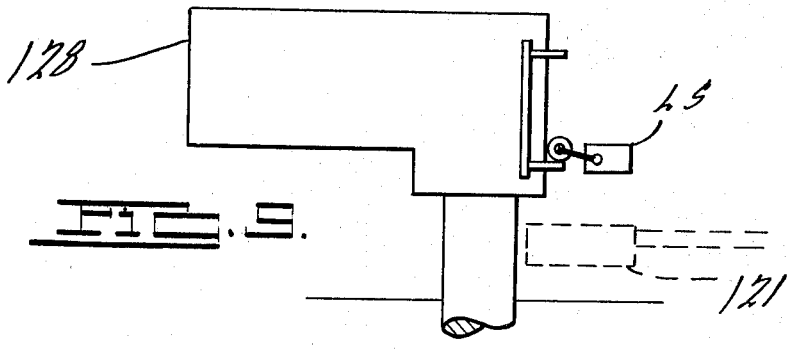
FIG. 9 is a schematic view taken along line 9-9 of FIG. 8 to show the relative position of the automatic pouring ladle relative to a portion of one of the piston molding machines.

Reference is now made to FIGS. 7 through 9 in order to describe the preferred positioning of the various limit switches used in conjunction with the aforedescribed cam rotary switches CS1A-CS6A and CS1B-CS4B to provide automatic control over the operation of the entire piston casting installation. As can be seen from a perusal of these figures limit switches are positioned in various places about the pouring ladle apparatus 110 in order to be contacted thereby and undergo a change in condition such as "off" to "on" and "on" to "off" depending on the particular limit switch involved. In FIG. 7*a*, ladle 121 is shown in the "fill" position by the solid lines and in the "pouring" position over each of the piston molding machines PM Left and PM Right respectively by phantom lines. When ladle 121 is in the "fill" position rotary cam switch CS1A is actuated.

As already described cam switch CS1A is operated by a geared chain drive attached to the vertical rotating axis of the traverse unit which moves the ladle from "fill" to "pour" positions and back to "fill" position. Limit switch LS4 is actuated when ladle 121 is in the "pour" position at molding machine PM Right and limit switch LS3 is actuated when ladle 121 is in the pour position for molding machine PM Left. As can be seen in the Figure these switches, LS4 and LS3, respectively, are positioned in proximity to arms 192K and 192L carried by traverse unit 119 for contact therewith which actuate the respective switch when the swinging arm 120 has been rotated to the pour position over either of the molding machines PM Left or PM Right as best shown in FIG. 7*a*.

A pneumatically operated brake 141 (best seen schematically in FIG. 1) which may be a Horton Air Champ Model M.W., Horton Manufacturing Company Inc., Minneapolis, Minnesota 55414, is fitted to the vertical axis of traverse drive 119. Brake 141 is activated by the same signal which stops motor 119*a* and stops the swing of the pouring arm 120 at each pouring position and at the ladle fill position. Brake 141 is released after a time sufficient for pouring arm 120 to have stopped its traverse movement.

Figure 10:
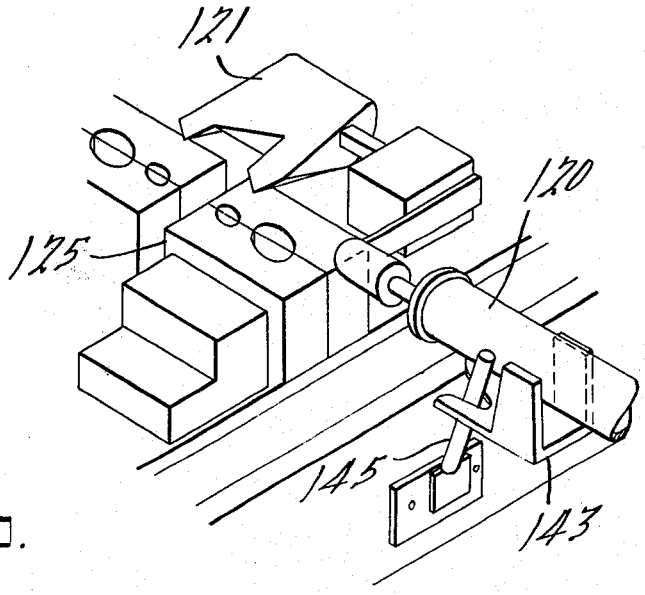
FIG. 10 shows a pin and clevis locating arrangement for positively positioning the swinging arm during pouring of the ladle.

Following release of the brake, the ladle is lowered to the mold. FIG. 10 shows a locating clevis 143 and pin 145 with the swinging arm in the down position. Clevis 143 is attached to swinging arm 120. A pin as shown at 145 is attached to each piston molding machine. The clevis and pin serve to positively locate swinging arm 120 in the correct position for pouring the ladle 121 into the molds.

Cam switch CS4A (best shown in FIG. 2) is closed when ladle 121 is in the dump position (safety position) as shown in the drawings and is arranged by means of a timer (described further hereinbelow) to be actuated if ladle 121 has not poured metal within a certain predetermined time, such as 26 seconds, after receiving the molten charge from holding furnace 115. CS4A closes each time the arm swings but is not effective unless abort timer TD1 has timed out.

Referring to FIG. 9, the relationship of ladle 121 to unloader arm 128 is shown. Unloader arm 128 in the particular installation shown must be in a raised position as shown to allow ladle 121 to clear it as it moves over the piston molding machine.

As previously described FIG. 1 shows a mechanism by means of which ladle 121 and arm 120 may be positioned closer to the mold into which the ladle is to pour the molten metal. Electric motor 118*d* driving through gear train 118*f* rotates arm 120 and ladle 121 about the pivot points of the linkage 118*a*. Limit switch LS1 signals the control to stop the motor when in the upper position. Limit switch LS2 signals the control to stop the motor when in the lower position. Switches LS1 and LS2 may be neutral position switches with dual functioning or may be individual control switches.

Filling and traverse of the ladle may be done in the upper or raised position depending on the particular installation. The ladle is lowered to the molds before being tilted to pour the molds. The lowering of the ladle reduces metal turbulence during pouring by reducing the vertical drop through which the metal falls. This reduction in turbulence reduces the "skim-gas" type of defect.

Figure 11:
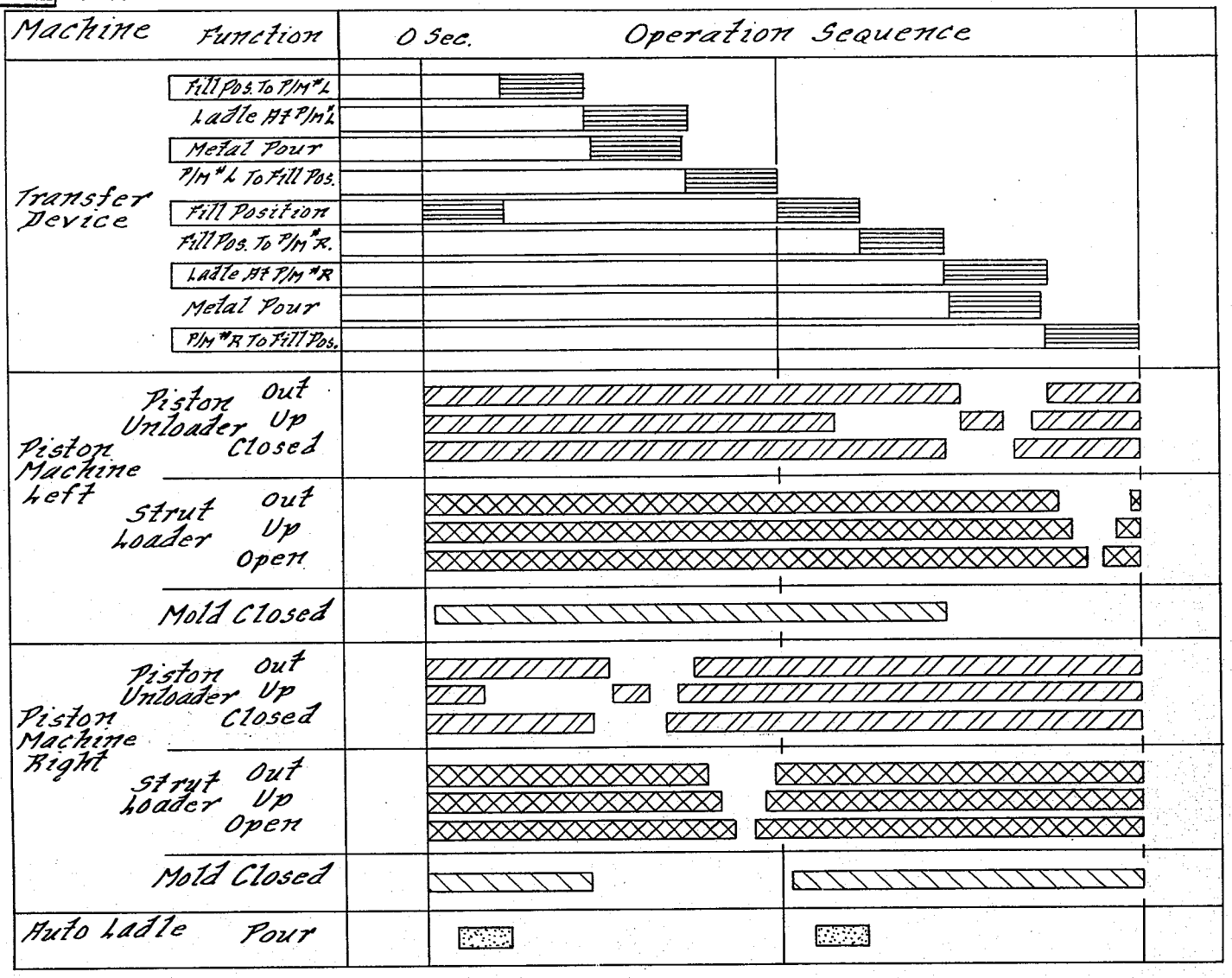
FIG. 11 is a bar type chart showing the operational sequences of the basic components of an entire piston making assembly including an automatic pouring ladle, two piston molding machines and a holding furnace which meters the molten metal into the automatic pouring ladle.
Figure 1C:
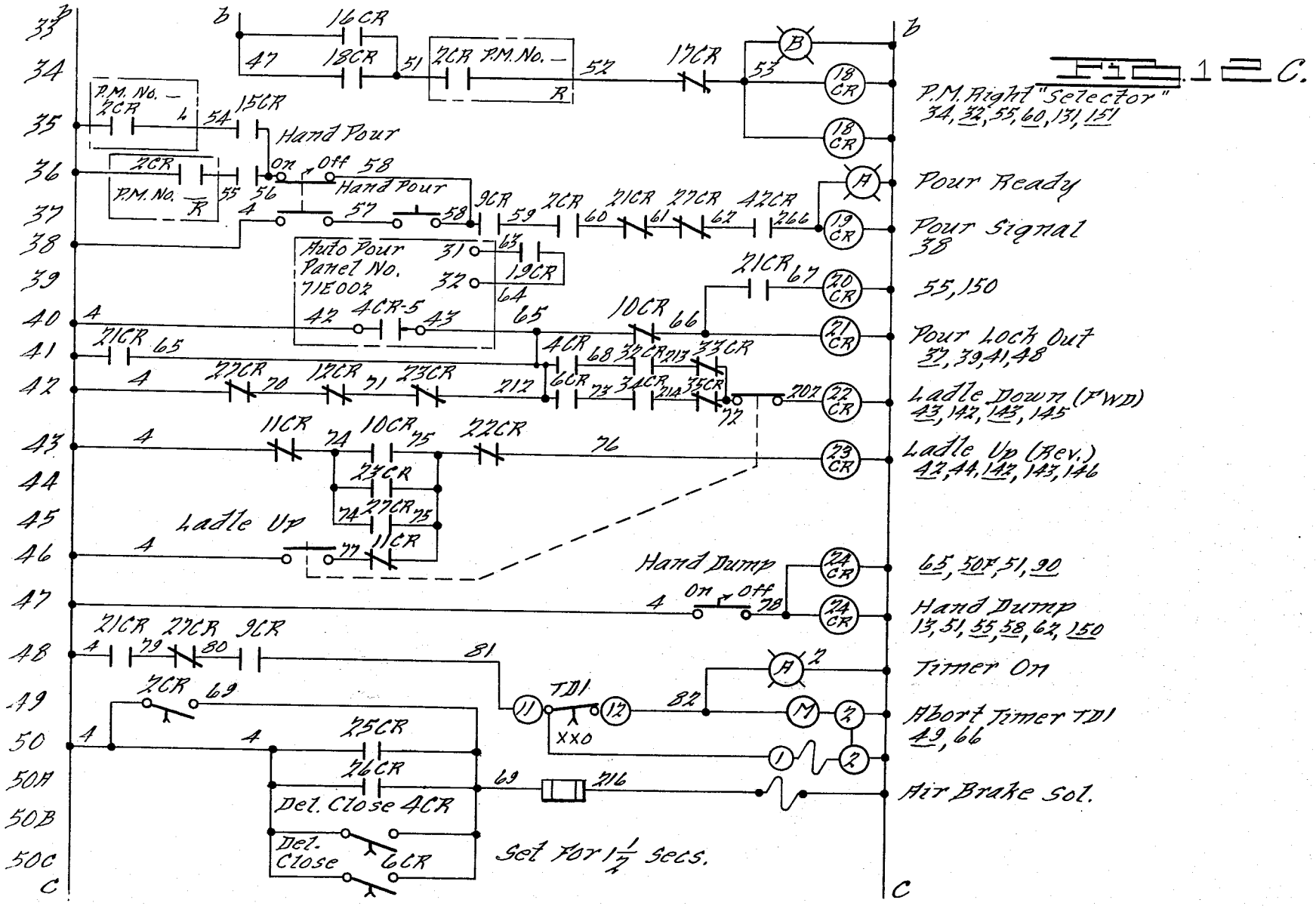
Figure 11F:
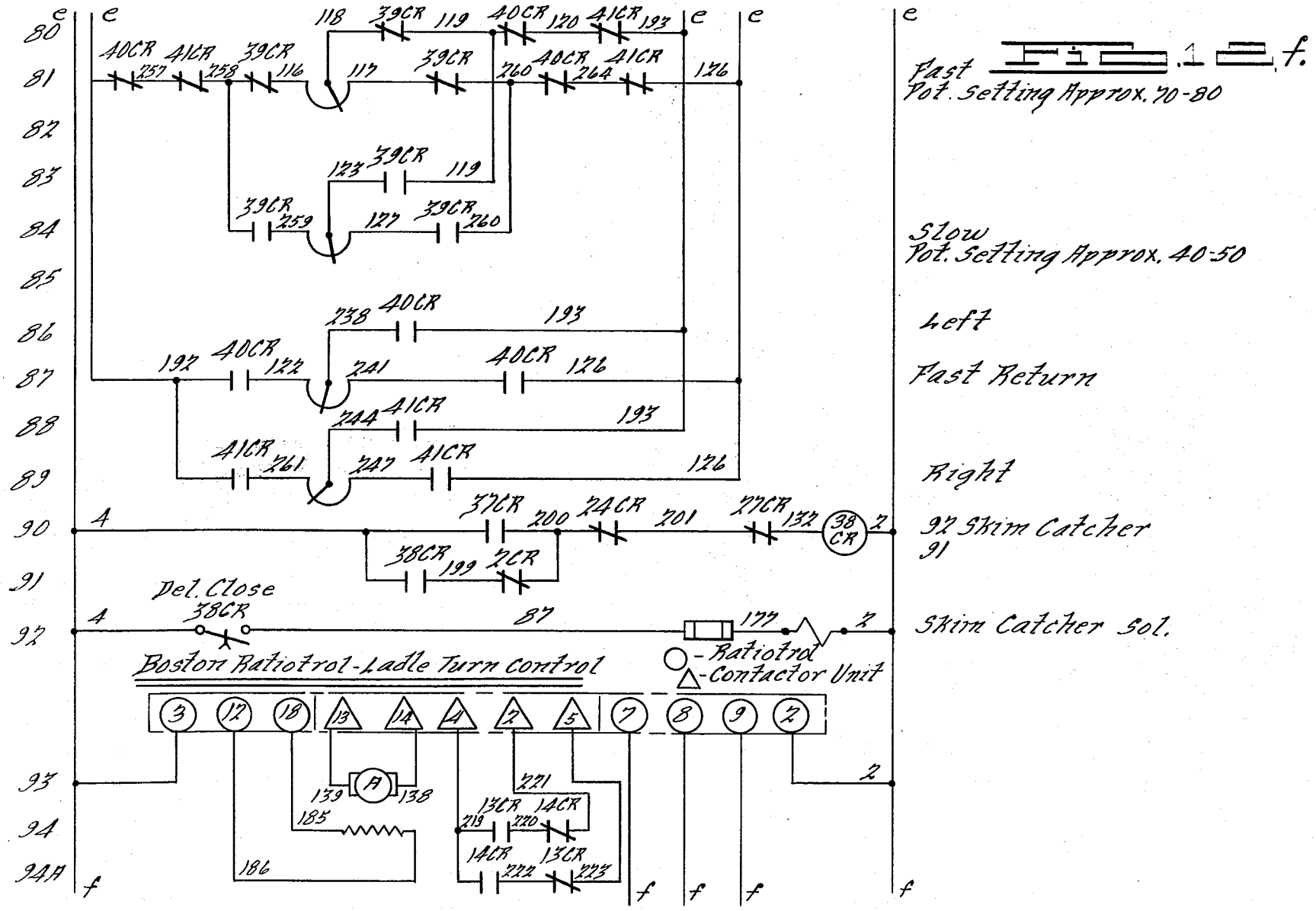

FIG. 11 illustrates the timing of the various operational sequences for the pouring ladle apparatus, piston machines PM Left and Right, and the metering of molten metal from holding furnace 115 which provides a charge to the pouring ladle 121. Under "piston unloader" the designation "out" indicates that unloader arm 128 is moved out of the way of the mold. "Up" indicates that it is in the raised position and "close" indicates that it is gripping the cast pistons to remove them from the mold. Under "strut loader" the term "out" indicates that loader 126 is swung out of the way of the mold, "up" indicates that it is in a raised position while "open" indicates that loader 126 is not placing struts in the mold.

Before proceeding with a detailed description of the various steps occurring in an operational sequence, it might be helpful to briefly review the overall sequence of operation. As can be seen at this point, four interconnected units are utilized in the preferred best mode embodiment of the piston casting installation: two piston molding machines, one holding furnace-dispensing means and one ladle pouring apparatus or transfer device. The ladle pouring apparatus involves three separate motions, the swing of its swinging arm by means of a rotary means, the tilt of its pouring ladle by another rotary means in a different plane and a vertical-lateral positioning of the ladle through a linkage system.

An automatic cycle is originally started by setting selector switches (not shown) on each of the four units and starting one of the two piston molding machines. At this point one molding machine will start its strut placing cycle, the ladle pouring apparatus will be in the fill position and the holding furnace will be in its ready condition to meter a charge into the ladle. The first molding machine to complete strut placing will interlock the pouring ladle apparatus to its cycle and will interlock the second molding machine out until completion of a first pouring cycle relative to itself. Completion of strut placing initiates the holding furnace which pours a previously determined amount of metal into the pouring ladle. Completion of this pour cycle and verification that the molding machine strut placer arm is clear of the mold initiates the swing of the ladle from the fill point to the pour point at the previously selected piston molding machine.

Completion of the ladle movement and verification that the molding machine molds are closed initiates the linkge drive system to position the ladle over and close to the mold. When the ladle is lowered and positioned correctly limit switch LS2 initiates tilt of the ladle to pour the metal into the mold. When the ladle is empty of molten metal the skim catcher 124*h* is positioned under the ladle to catch the skim which drops from the ladle at the full tilt position. When the ladle is fully tilted up (referred to herein as "ladle vertical" although it may be overcentered at the end of the tilting action), a cooling cycle timer (not shown) on the molding machine is initiated and the molding machine cycles independently through cooling, the mold is opened, the pistons are unloaded and struts are placed so that the machine is in the ready condition described at the start of this operation. The transfer device in the meantime will have continued to operate and while it is returning to its horizontal position it will traverse back to the fill position. On reaching the fill position the skim catcher **124*h* dumps the skim by means of retraction under scraperplate 124K.**

As will be seen below in the detailed description of the electrical control circuit according to this invention certain failure safeguards are provided. The start of the metal metering from the holding furnace into the ladle initiates an abort timer in the ladle pouring apparatus circuit. This timer ceases to operate normally when the pour sequence is completed and the ladle has returned to the horizontal position. If some portion of the operation takes too long or fails completely the timer times out and a failure sequence is initiated. Preferably, a horn or the like will sound while the ladle is moved from any position it happens to be in to a dump position. Verification that it is in the dump position initiates ladle tilting to pour the metal into a suitable drain pan or the like. When the ladle has returned to the horizontal position after dumping of the molten charge, it is moved back to the fill position. At this point, the electrical control circuit will shut the apparatus down and it must be reset by an operator who has investigated the alarm. The molding machines continue to cycle to their ready condition.

Figure 12A:
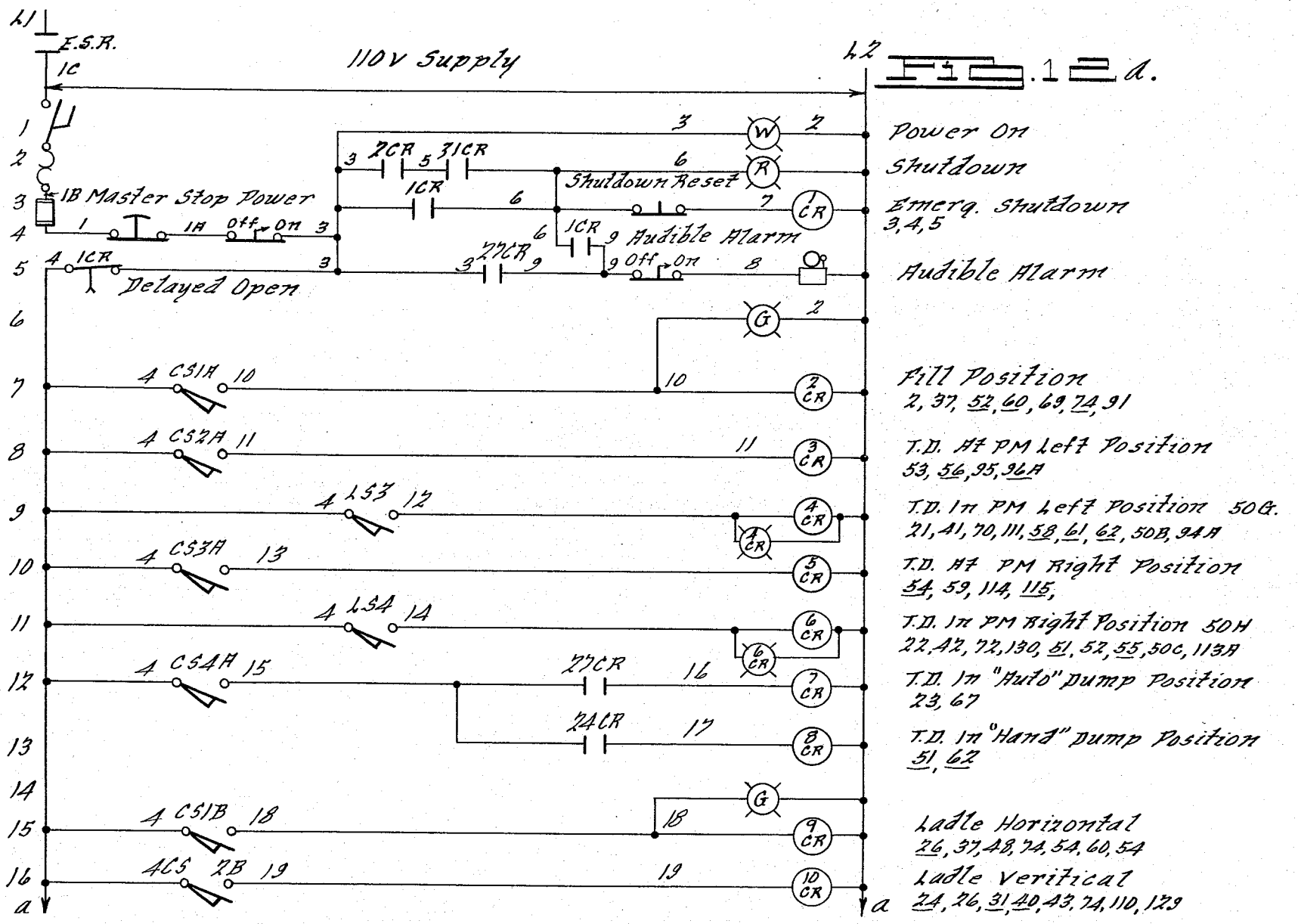
FIG. 12 is a ladder-like electrical schematic showing the electrical control circuit and other electrical components which control the automated function of the automatic pouring ladle; the Figure includes portions 12*a* through 12*h*.
Figure 12B:
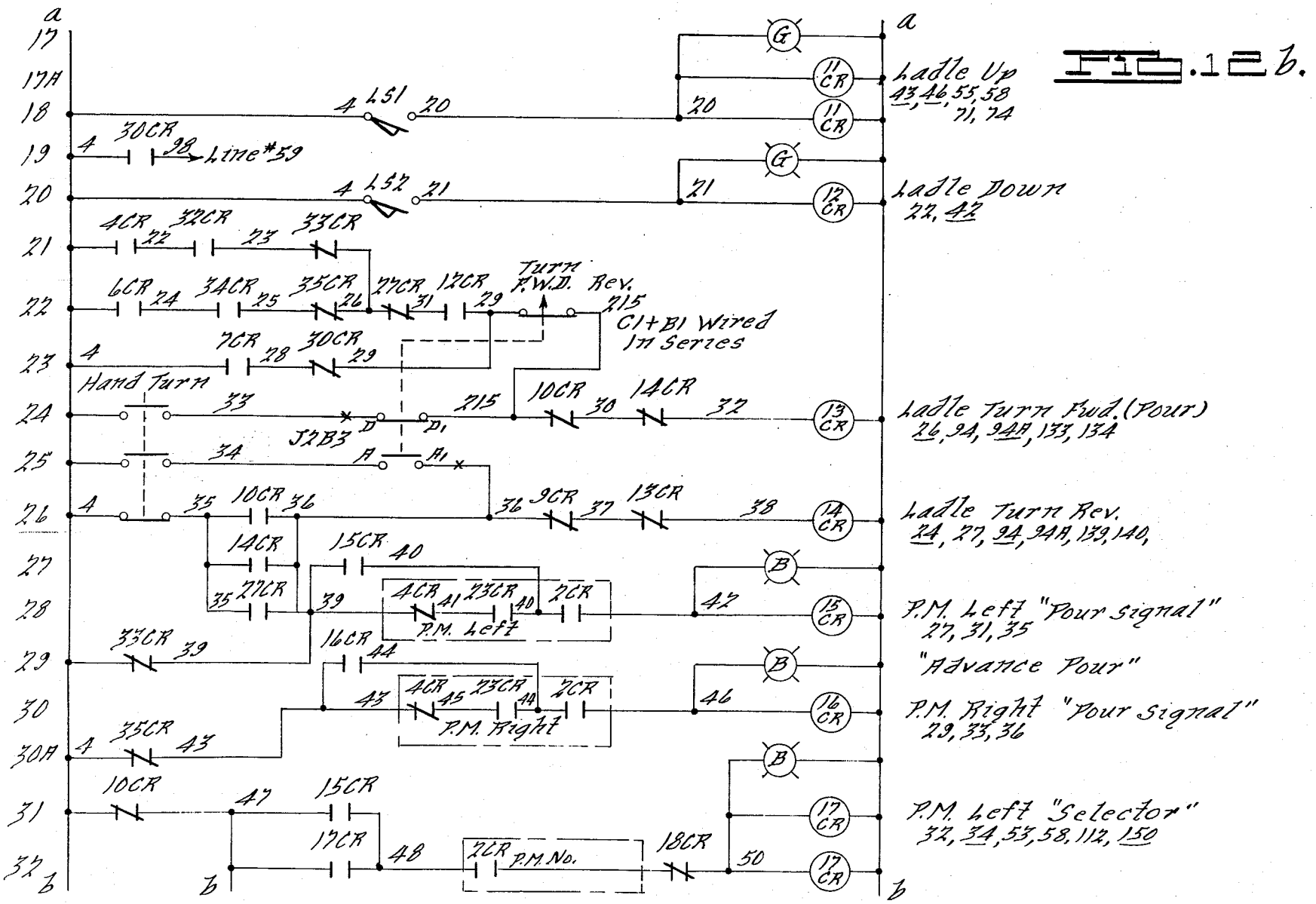
Figure 12D:
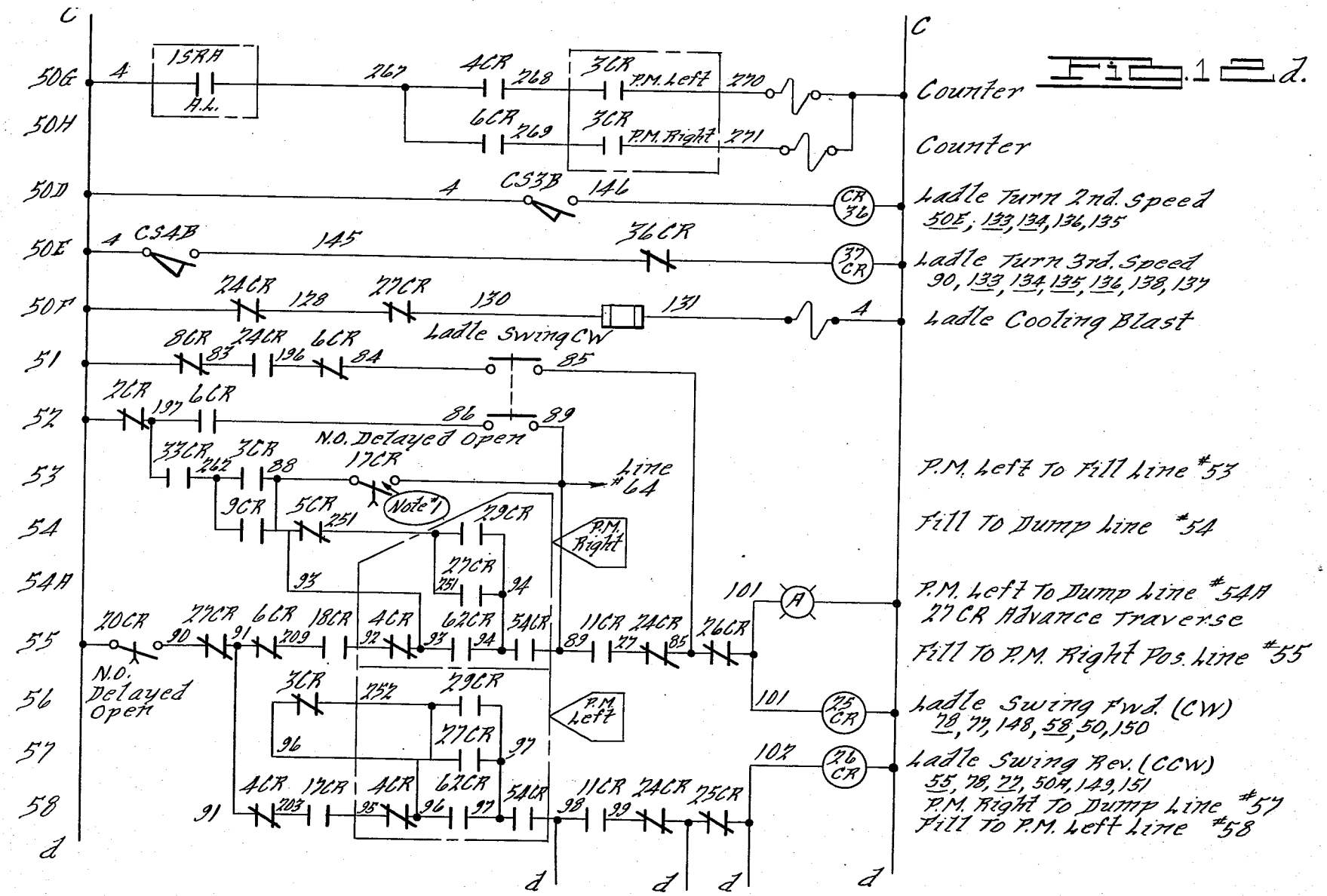
Figure 12E:
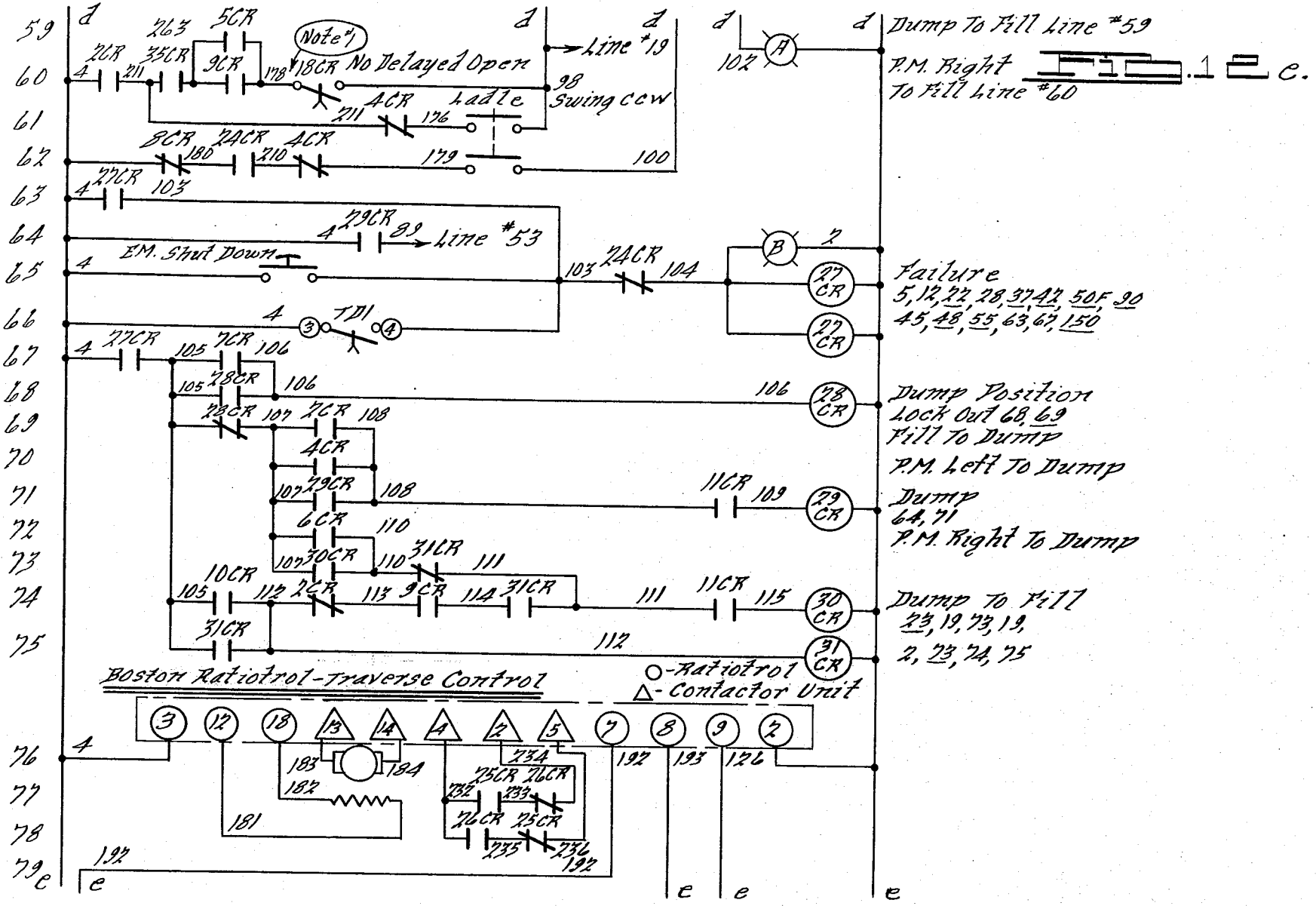
Figure 12:
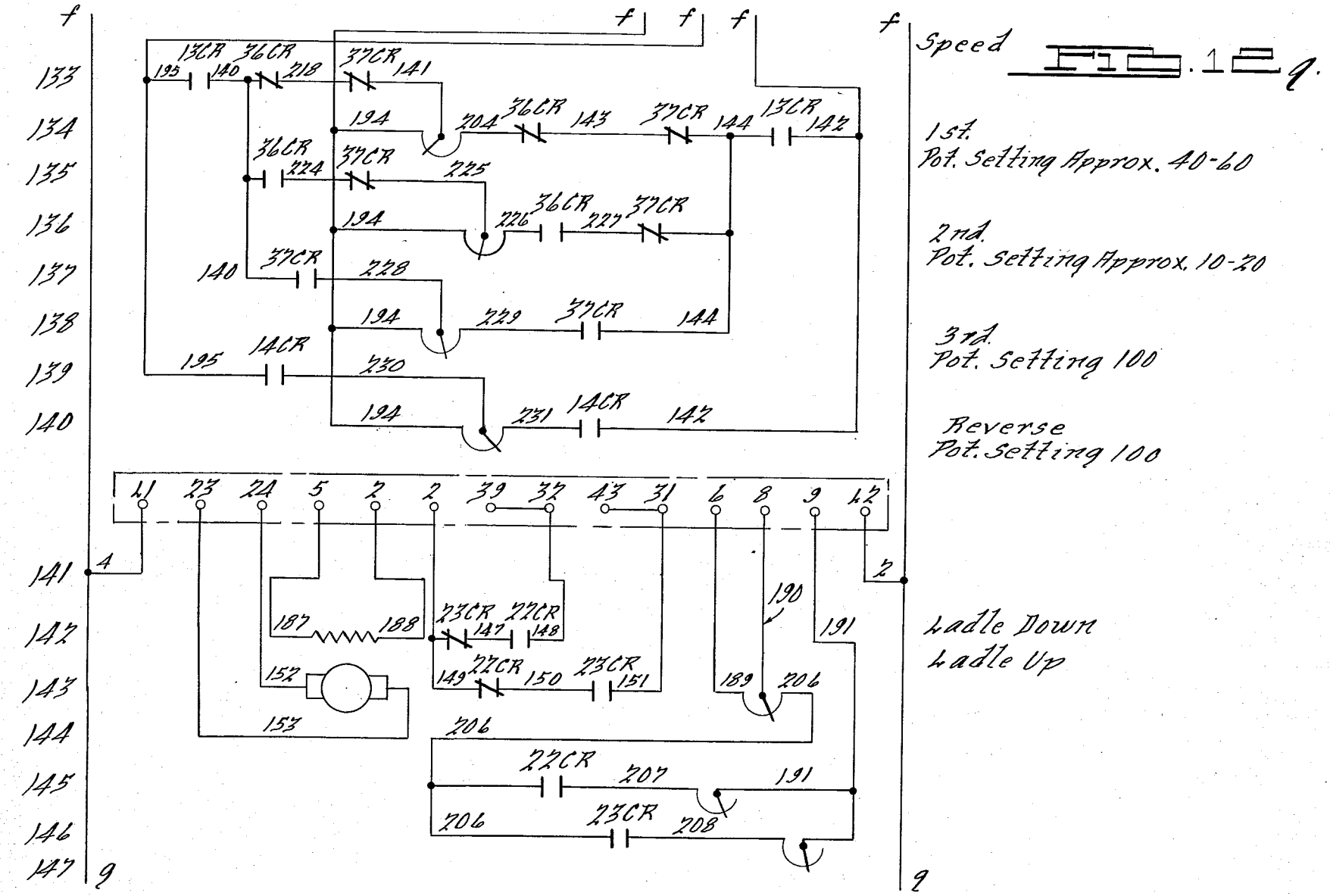
Figure 12H:
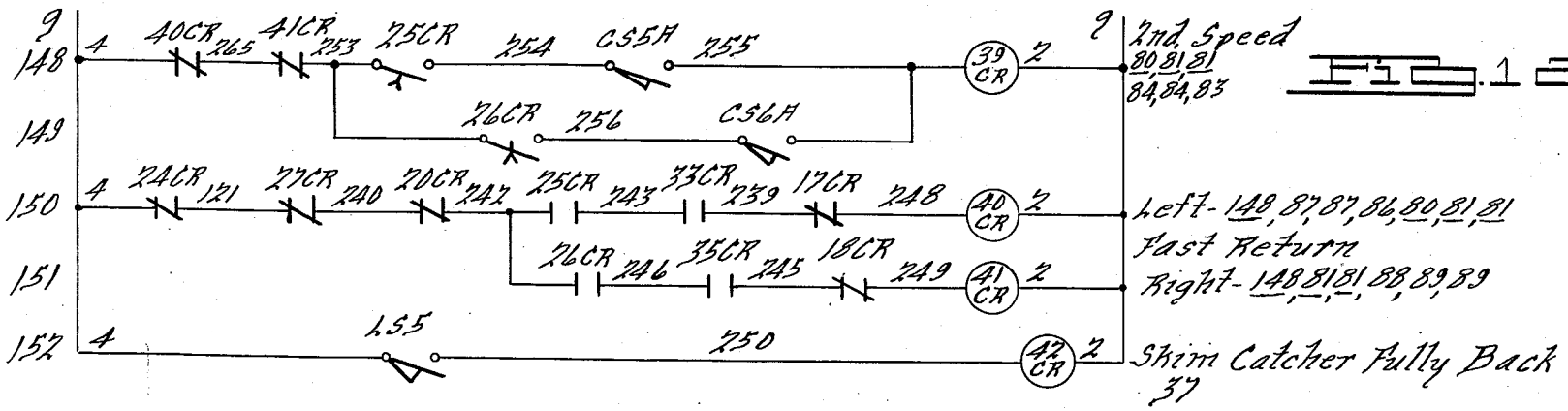
Figure 15:
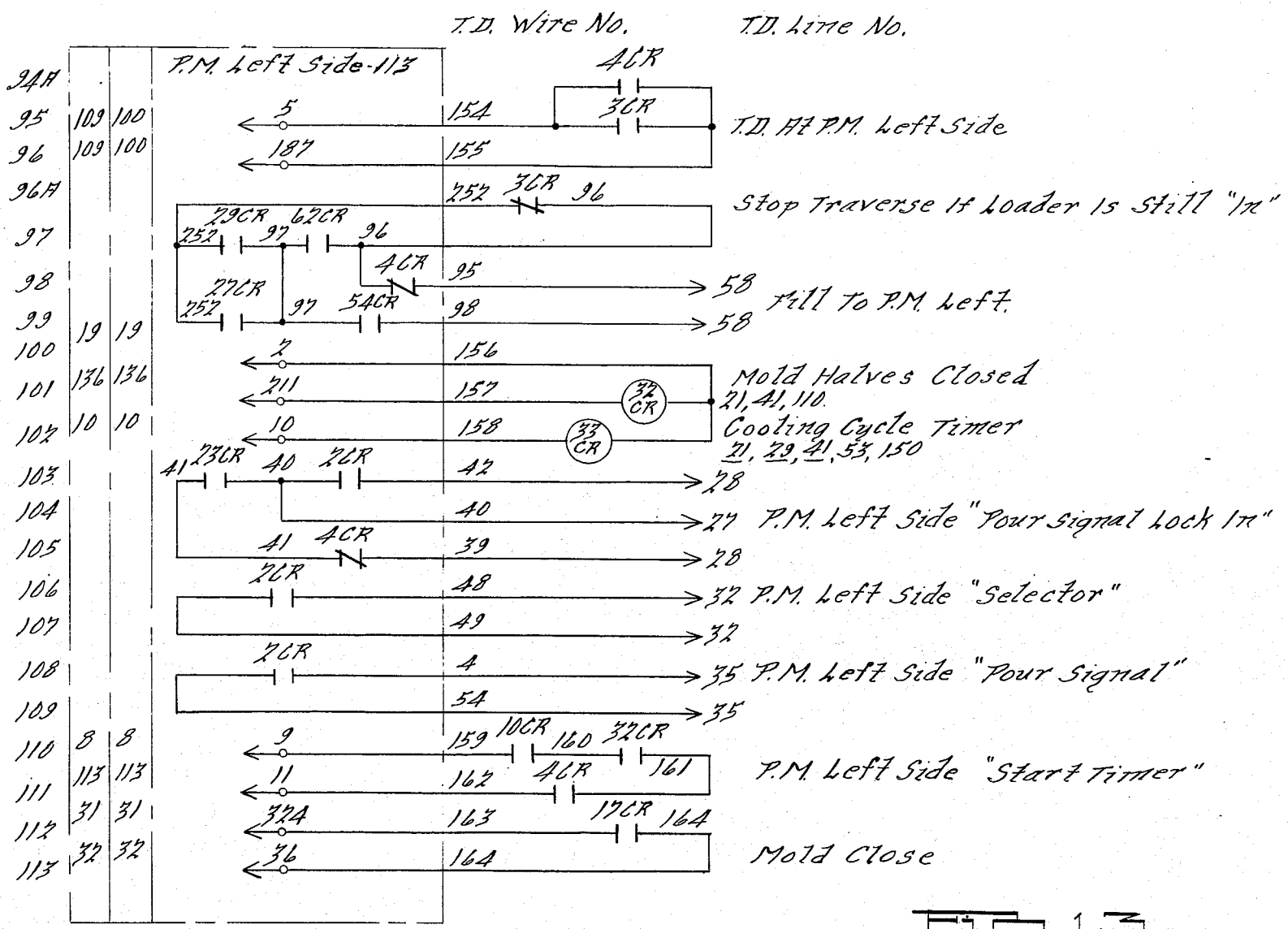
Figure 14:
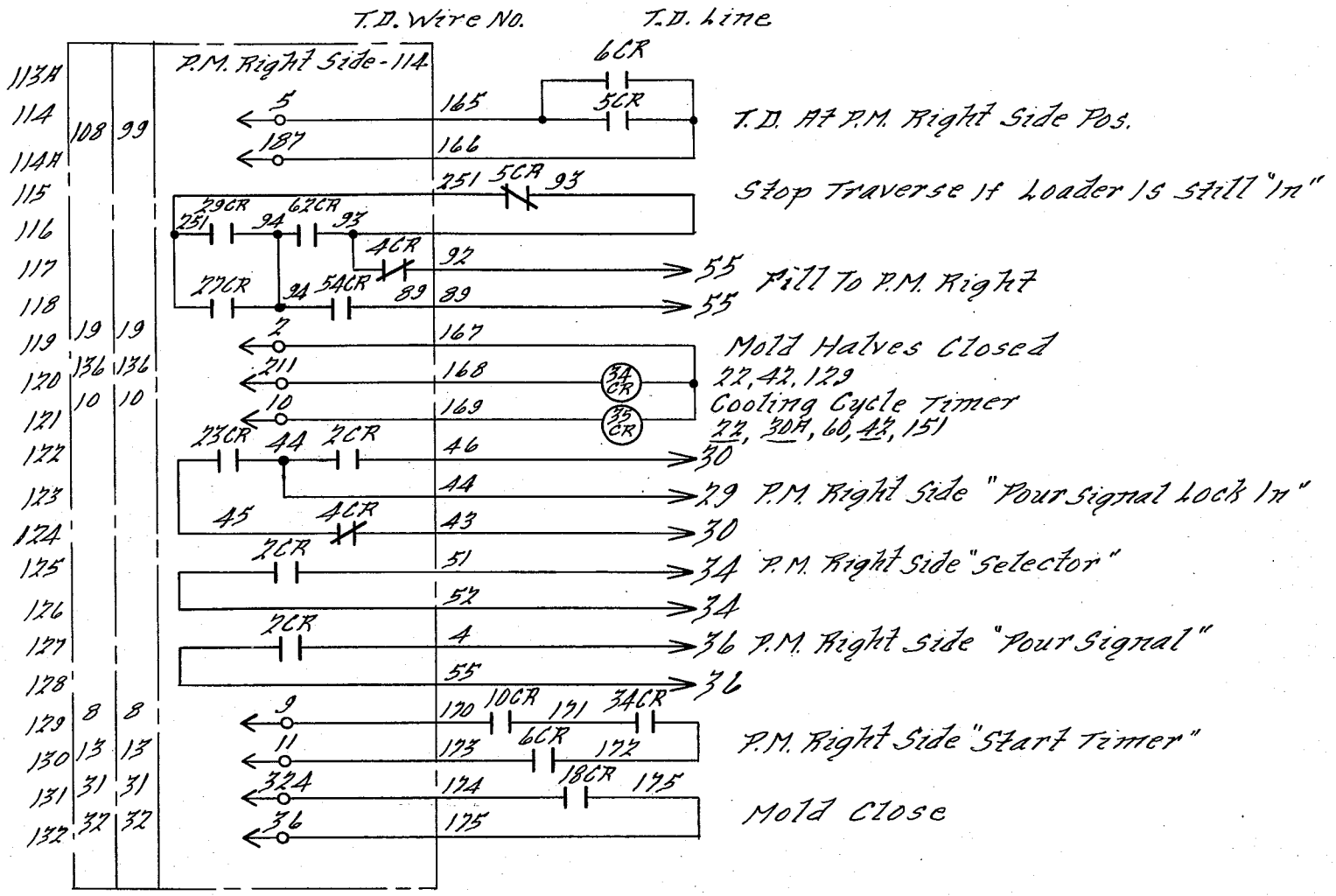

Referring now to FIGS. 12, 13 and 14, the electrical inter-relationship of the piston molding machines, the furnace metering device and the transfer device will be discussed in detail. FIG. 12(*a–h*) is an electrical schematic of the circuit for the transfer device. FIG. 13 is an electrical schematic of the inter-connecting circuit between the transfer device electrical circuit and the electrical circuit of the piston molding machine Left. FIG. 14 is a similar inter-connecting circuit between the transfer device and piston molding machine Right. The electrical sequence involved in the transfer device operation and the associated automatic piston molding machines together with the furnace metering unit will now be described in a step by step manner referring to the electrical schematics of FIGS. 12, 13 and 14.

Rest or Start Positions

At this stage, all four units involved, namely the two permanent molding machines, the transfer device, and the furnace metering unit, have been turned on and are ready to be placed in operation but no production has yet occurred. In this position, on piston machine Left, the unloader is over the discharge, the loader is over the pick-up and the machine is in the automatic cycling position. In FIG. 13, this involves 2CR (control relay contacts) 29CR, 54CR, 62CR being closed. 2CR stays energized so long as production is in progress and will not be referred to subsequently. 4CR being a "Manual" contact stays closed, also. On the transfer device, the ladle is in the fill position, the brake is off, the ladle is in the horizontal and up position. In FIG. 12, cam switches CS1A and CS1B along with limit switches LS1 and LS5 are all in a closed position. The "Air Brake" solenoid is energized; the ladle unit is providing outgoing signals by means of contact relays 2CR, 9CR, 42CR being energized and indicating that the unit is in the "fill" position with the skim catcher fully back, the ladle is horizontal and in the "up" position.

PM Left Cycle. Step No. 1 — Start Cycle

For the purposes of the description, it is assumed that PM Left leads by going into its automatic cycle and bringing its loader in closing 23CR contact in FIG. 13. The "loader over the pick-up" contact 62CR in FIG. 13 opens. No other changes take place at this stage.

PM Left Cycle. Step No. 2 — Pour Signal Lock-In

The action described in Step No. 1 results in the PM Left issuing a signal that PM Left pour signal is locked in by the closing of 15CR in FIG. 12. All other electrical conditions remain the same as in preceding Step No. 1.

PM Left Cycle. Step No. 3 — P.M. Selector

An outgoing signal that the mold should close is issued through 17CR. In FIG. 12, the pouring ladle issues two signals first that PM Left has been selected by energizing 17CR and second that the pour is required by energizing 15CR. All other electrical conditions remain the same as in preceding Step No. 2.

P.M. Left Cycle. Step No. 4 — Pour Ready Signal

The pour ladle PM Left pour signal relay CR15 shown in FIG. 12 now issues an instruction to the metering furnace to pour metal. All other electrical conditions remain as in preceding Step No. 3.

PM Left Cycle. Step No. 5 — Pour Metal

A signal from 19CR FIG. No. 12 is now issued to the metering furnace which now pours metal. All other electrical conditions remain the same as in preceding Step No. 4.

PM Left Cycle. Step No. 6 — Pour Lock-Out

At this stage, the metal has been poured from the furnace to the ladle and the automatic metering furnace is deenergized. The abort timer is started by energizing TD1. A signal enters the pouring ladle from the metering furnace that the metering furnace is locked out and can no longer pour by the energizing of 21 and 20 CR. All other electrical functions in Step No. 6 are the same as in preceding Step No. 5.

PM Left Cycle. Step No. 7 — Ladle Swing C.C.W.

62CR is closed again (FIG. 13) as the loader is fully back in the "over Pick-Up" position. In FIG. 12 contacts 17CR, 62CR, 54CR and 11CR being closed applies power to 26CR (FIG. 12) which in turn provides a signal to the Boston Traverse Control Unit which starts the C.C.W. traverse motion.

PM Left Cycle. Step No. 8 — Pouring Ladle Movement Counter-Clockwise

In FIG. 12, CS1A is open indicating that the pouring ladle is no longer in the fill position. 2CR de-energizes again because the pouring ladle is no longer in the fill position. The pouring ladle now is moving from the fill position to the PM Left position. All other electrical functions are the same as in the preceding Step No. 7.

PM Left Cycle. Step No. 9 — Ladle at PM Left Position

A signal now goes to PM Left that the pouring ladle is at PM Left position. This signal is provided by the closing of CS2A indicating that the ladle is at PM Left.

All other electrical functions are the same as in preceding Step No. 8.

PM Left Cycle. Step No. 9A

As the pouring ladle approaches the "in" position CS5A is closed energizing 39CR. 39CR selects a 2nd speed potentiometer (slow) dropping out the "Fast" potentiometer. This slows down the traverse motion of the pouring ladle. The potentiometers are part of the control circuit of standard variable speed electric motor controls. Such a circuit may be provided by Boston Ratiotrol 300 Series, North American Rockwell.

PM Left Cycle. Step No. 10 — Ladle in PM Left Position

In FIG. 12, 3LS is closed with the ladle in the PM Left position. 4CR is now energized with the ladle in the PM Left position. The air brake solenoid being normally open will stop the ladle movement. After 1½ seconds the air brake solenoid will be re-energized through the closing of 4CR delayed contact therefore freeing the ladle. All other electrical functions at this stage are the same as in Step No. 9.

PM Left Cycle. Step No. 11 — Ladle Down

In FIG. 12, the pouring ladle ceases to indicate it is in the up position by the opening of 1LS. The ladle up control relay 11Cr is de-energized. The mold halves being closed provide a signal which energizes 32CR (FIG. 13). The "ladle down" control relay 22CR is now energized, supplying power to the "speed drive." All other electrical functions are the same as in the preceding Step No. 10.

P.M. Left Cycle. Step No. 12 — Ladle Fully Down

The closing of LS2 in FIG. 12 now indicates that the ladle is in the down position. The ladle down control relay 12CR is now energized. 22CR (ladle down forward) is now de-energized. All other electrical functions are the same as in the preceding Step No. 11.

P.M. Left Cycle. Step No. 13 — Ladle Motor Turning

Ladle motor drive on control relay No. 13CR is now energized. The ladle motor is now turning rotating the ladle to give a pour. CS3B and CS4B controlling 36CR and 37CR regulate the required speed by means of potentiometer selection. All other electrical functions are the same as in preceding Step No. 12.

P.M. Left Cycle — Step No. 14 — Ladle Motor Turning

In FIG. 12 the opening of cam switch CS1B indicates the ladle is no longer horizontal. The abort timer TD1 is now de-energized, and the ladle horizontal control relay No. 9CR is de-energized. Cam switch CS4B energizing 37CR will supply power to the skim catcher solenoid. The skim catcher will move forward opening 5LS and drop out 42CR. All other electrical functions are the same as in the preceding step No. 13.

PM Left Cycle — Step No. 15 — Ladle Vertical — PM Right Cycle — Start Cycle

In FIG. 13 a signal is issued to PM Left through 10CR contact to start the timer in that machine and the mold close signal is cancelled. PM Right is now manually started up by the operator. In FIG. 12 the fact that the ladle is now vertical is signalled by the closing of CS2B and the ladle vertical control relay 10CR is energized. The ladle return reverse No. 14CR is also energized supplying power to the Ladle Turn Control and the selection of PM Left as the machine to be poured by the pouring ladle is cancelled by the de-energizing of 17CR. The incoming signal from the autoladle that it is locked out is cancelled by the de-energizing of the "Autoladle Pour Lock-Out" control relay No. 20CR and 21CR. All other functions are the same as in preceding Step No. 14.

PM Left Cycle. Step No. 16 — Ladle Return to Horizontal — PM Right Cycle — Pour Signal Lock The ladle vertical control relay 10CR de-energizes in FIG. 12. The PM Left pour signal lock-in control relay 15CR also de-energizes the PM Right pour signal lock-in control relay 16CR now energizes. All other electrical functions remain the same as in Step No. 15.

PM Left Cycle. Step No. 17 — Ladle Horizontal — PM Right Cycle — PM Right Selector In FIG. 14, 23CR contact closes. In FIG. 12 the ladle horizontal position is indicated by the closing of cam switch CS1B energizing ladle horizontal control relay 9CR which in turn drops out 14CR Ladle Turn Reverse Relay. The ladle motor ceases to turn. The ladle return to horizontal position control relay 14CR is de-energized. The PM Right selector control relay 16CR is now energized indicating that PM Right has been selected as the next machine to be poured by the pouring ladle. All other electrical functions are the same as in preceding Step No. 16.

PM Left Cycle. Step No. 18 — Ladle Up

In FIG. 12 the fact that the ladle is up in indicated by the closing of LS1 and the opening of LS2. The ladle up control relay 23CR is now energized supplying power to the ladle up speed drive. All other electrical functions are the same as in preceding step No. 17.

PM Left Cycle. Step No. 19 — Transfer Device Return to Fill Position

In FIG. 12, 25CR Ladle Swing Fwd Relay is energized permitting the transfer device (TD) to move from the PM Left position to the fill position. The ladle being fully up will close 1LS energizing 11CR which in turn will de-energize 23CR. All other electrical functions are the same as in preceding Step No. 18.

PM Left Cycle. Step No. 20 — Transfer Device Returning to Fill Position

In FIG. 12 the transfer device indicates that it is no longer in the PM Left position by the opening of LS3 and ladle in PM Left position control relay 4CR is now de-energized. All other electrical conditions are the same as in the preceding step No. 19.

PM Left Cycle. Step No. 21 — Transfer Device Returning to Fill Position

In FIG. 13 the signal that the transfer device is at the PM Left Position has been cancelled. In FIG. 12, the opening of CS2A indicates that the transfer device is no longer at the PM Left position. The "transfer device at PM Left position" control relay 3CR is now de-energized. All other electrical functions are the same as in preceding Step No. 20.

PM Left Cycle. Step No. 22 — Transfer Device in Fill Position

In FIG. 12, the transfer device in the fill position is indicated by the closing of CS1A. The ladle swing fwd relay 25CR is de-energized and the air brake stops the movement of the ladle. The fill position control relay 2CR is now energized. All other electrical functions are the same as in preceding Step. No. 21.

PM Left Cycle. Step No. 23 — Skim Catcher Back. PM Right Cycle. Step No. 1 — Pour Ready The closing of 2CR will de-energize 38CR which in turn removes the power from the skim catcher solenoid. The skim catcher returns closing 5LS which in turn energizes 42CR. The pour signal control relay 19CR is now energized. All other electrical functions are the same as in preceding Step No. 22.

PM Right Cycle. Step No. 2 — Pour Ready Signal

A signal is transmitted to the furnace metering device to pour the metal by the closing of pour signal control relay 19CR in the preceding step. All other electrical functions are the same as in preceding Step No. 23-1.

PM Right Cycle. Step No. 3 — Pour Metal

The autoladle having received the signal to meter metal now proceeds to go into its pour cycle. All other electrical functions in FIGS. 12, 13 and 14 remain as in preceding Step No. 2.

PM Right Cycle. Step No. 4 — Pour Lock-Out

A signal arriving from the Lindberg autoladle that the autoladle unit is now locked out and has stopped pouring, deenergizes pour signal control relay 19CR and energizes the autoladle pour lock-out control relay 20CR and 21CR. The abort timer TD1 is now started so that if the pouring of the pistons is not accomplished in the period the timer is set for, the unit will enter into the abort cycle. All other electrical functions remain the same as in the preceding PM Right cycle — Step No. 3.

PM Right Cycle — Step No. 5 — Ladle Swing C.W.

17CR, 62CR, 54CR and 11CR being closed energize 25CR ladle swing fwd, which in turn provides a signal to the traverse control unit starting the forward motion of the ladle. All other electrical functions remain the same as in the preceding PM Right cycle — Step No. 4.

PM Right Cycle. Step No. 6 — Transfer Device Moved Clockwise

Fill position control relay 2CR is now de-energized, and energizing of the clockwise motion control unit starts the transfer device moving from the fill position to the PM Right position. Cam switch CS1A opened indicating the transfer device is no longer in the fill position. All other electrical functions remain the same as in the preceding PM Right cycle — Step No. 5.

PM Right Cycle. Step No. 7 — Transfer Device at PM Right Position

The closing of cam switch CS3A now indicates that the transfer device is at the PM Right position. The closing of the "transfer device at PM Right position" control relay 5CR issues a signal to PM Right, FIG. 14, that the transfer device is now at the PM Right position. As the pouring ladle approaches the "in" position, CS6A is closed energizing 39CR. 39CR selects a 2nd speed potentiometer (slow) dropping out the fast speed potentiometer, slowing down the fast traverse motion, the potentiometer being in the motor control circuit.

PM Right Cycle — Step No. 8 — Transfer Device in PM Right Position

25CR Ladle Swing Fwd control relay is de-energized and the closing of limit switch 4LS indicates that the transfer device is in the PM Right position. Transfer device in PM Right position control relay 6CR is now energized. In FIG. 13 an incoming signal from PM Left de-energizes cooling cycle timer control relay 33CR. All other electrical functions remain the same as in preceding PM Right Cycle — Step No. 7.

PM Right Cycle. Step No. 9 — Ladle Down

The closing of 4LS in preceding Step No. 8 results in the energizing of ladle down control relay 22CR. The ladle down speed drive control is energized. The movement of the ladle in a downward direction results in the opening of the ladle up limit switch LS1. In FIG. 13 a signal is received from PM Left which opens the "mold half closed" control relay contact 23CR. All other electrical functions remain the same as in preceding PM Right cycle — Step No. 8.

PM Right Cycle. Step No. 10 — Ladle Fully Down

The closing of ladle down limit switch 2LS now indicates that the ladle is in the fully down position. This results in the energizing of ladle down control relay 12CR. At the same time in FIG. 13 an incoming signal from PM Left indicates that the unloader has now left the discharge position and opens control relay contact 54CR. All other electrical functions remain the same as in preceding PM Right cycle — Step No. 9.

PM Right Cycle. Step No. 11 - Ladle Motor Turning

Ladle turn forward control relay 13CR is now energized and the ladle motor starts to turn to pour the piston molds in PM Right. All other electrical functions remain the same as in preceding PM Right cycle — Step No. 10.

PM Right Cycle. Step No. 12 — Ladle Motor Turning

Ladle horizontal cam switch CS1B is now opened indicating that the ladle has turned from the horizontal position. The ladle horizontal control relay 9CR is now de-energized, the abort timer TD1 is also de-energized. A signal from PM Left meanwhile closes the unloader over discharge control relay contact 54CR. While the ladle is turning CS3B and CS4B controling 36CR and 37CR regulate the required speed by selecting speed potentiometers in the motor control circuit. Also 37CR by energizing 38CR applies power to the skim catcher solenoid bringing the catcher plate forward. The catcher plate going forward opens 5LS which de-energizes 42CR. All other electrical functions remain the same as in preceding PM Right cycle, Step No. 11.

PM Right Cycle. Step No. 13 — Ladle Vertical

As the ladle turns to pour the piston mold in PM Right it reaches a vertical position and closes cam switch CS2B. This results in the energizing of ladle vertical control relay 10CR. Ladle turn reverse control relay 14CR is also energized. The PM Right selector control relay 18CR; the incoming signal autoladle pour lock-out control relays 20CR and 21CR are de-energized. In FIG. 14 a signal is sent to PM Right to start the timer in that machine, and the mold close signal is cancelled. An incoming signal from PM Right energizes cooling cycle timer control relay 35CR. Meanwhile PM Left in FIG. 13 sends a signal which de-energizes the loader over pick-up control relay contact 62CR. All other electrical functions remain the same as in preceding PM Right cycle — Step No. 12.

PM Right Cycle. Step No. 14 — Ladle Return to Horizontal — PM Left Cycle. Pour Signal Lock The ladle is now returning to the horizontal position and the ladle vertical limit switch CS2B is now opened. Ladle vertical control relay 10CR is de-energized. The signal going to PM Right in FIG. 14 to start the timer in that position molding machine ceases. A signal coming from PM Right ceases and PM Right pour signal lock-in control relay 16CR drops out. At the same time a signal from PM Left, FIG. 13 energizes PM Left pour signal lock-in control relay 15CR. All other electrical functions remain the same as in preceding PM Right cycle — Step No. 13.

PM Right Cycle. Step No. 15 — Ladle Horizontal — PM Left Cycle Selector

The closing of cam switch CS1B now indicates that the ladle has returned to the horizontal position. Ladle horizontal control relay 9CR is now energized. The ladle turn reverse control relay 14CR is de-energized. The ladle motor thus ceases to turn.

PM Left functions occurring at this stage are that signals issued by PM Left in FIG. 13 close the loader over pick-up control relay contacts 62CR, 29CR and 54CR. A signal is sent to PM Left to close the mold and the PM Left selector control relay 17CR is now energized. All other electrical functions remain the same as in preceding PM Right cycle — Step No. 14.

PM Right Cycle. Step No. 16 — Ladle Up

In FIG. 12 the ladle down limit switch 2LS is now opened and the "ladle up" limit switch LS1 is closed indicating that the ladle is now in the up position. The ladle up control relay 11CR is now energized and the Ladle up Rev control relay 23CR is now de-energized. The transfer device is already returning to the fill position. "Ladle Down" control relay 12CR is now de-energized. All other electrical functions remain the same as in preceding PM Right cycle — Step No. 15.

PM Right Cycle. Step No. 17 — Transfer Device return to Fill Position

The Ladle Swing Reverse CCW Relay 26CR is now energized causing the transfer device to move from the PM Right position to the fill position. All other electrical functions remain the same as in preceding PM Right cycle. Step No. 16.

PM Right Cycle. Step No. 18 — Transfer Device Returning to Fill Position

Transfer device in PM Right position limit switch 4LS is now opened as the transfer device returns to the fill position. This results in the de-energizing of transfer device in PM Right position control relay 6CR. All other electrical functions remain the same as in the preceding PM Right cycle — Step No. 17.

PM Right Cycle. Step No. 19 — Transfer Device Returning to Fill Position

Transfer device at PM Right position cam switch CS3A is now opened. Transfer device at PM Right position control relay 5CR is de-energized. In FIG. 14 the outgoing signal to PM Right that the transfer device is at PM Right is now cancelled. All other electrical functions remain the same as in preceding PM Right cycle — Step No. 18.

PM Right Cycle. Step No. 20 — Transfer Device in Fill Position

The transfer device arriving in the fill position closes cam switch CS1A. Fill position control relay 2CR is now energized, the Ladle Swing reverse relay 26CR is de-energized causing the transfer device to stop moving. The skim catcher relay 38CR is de-energized removing power from the skim catcher solenoid. The skim catcher full back closes 5LS energizing 42CR. The air brake solenoid will be energized after a delay of 1½ seconds. All other electrical functions remain the same as in preceding PM Right cycle — Step No. 19.

Note: — With the aid of FIGS. 12, 13, and 14 the electrical inter-relationships between the transfer device, PM Left, PM Right, and the Lindberg Autoladle have been followed from the start-up of the combined units through the first pouring of PM Left and then the first pouring of PM Right. During the PM Right cycle, the PM Left molding machine has completed its cycle and at this stage is ready to be poured a second time. During the PM Right cycle description, reference has been made to steps occurring in the PM Left cycle. In the subsequent, second description of the PM Left cycle, reference will be made to the completion of the PM Right machine molding cycle. What is being described in the start of a continuous action where as one piston molding machine is poured, the other piston molding machine is becoming ready for pouring and as soon as the transfer device is available, it will service the second piston molding machine by pouring it. This repetitive cycle continues until such time as the interrelated units are shut down.

PM Right Cycle. Step No. 21 — PM Left Cycle. Step No. 1 —Pour Ready

Pour signal control relay 19CR is now energized for the start of the PM Left cycle. All other electrical functions remain the same as in preceding PM Right cycle — Step No. 20.

PM Left Cycle. Step No. 2 — Pour Ready Signal

A signal to the autoladle unit to pour metal is now sent. All other electrical functions remain the same as in preceding PM Left cycle — Step No. 1.

PM Left Cycle. Step No. 3 — Pour Metal

The autoladle having received a signal to pour in the preceding step, now pours metal to fill the ladle in the transfer device. All other electrical functions remain the same as in preceding PM Left cycle — Step No. 2.

PM Left Cycle. Step No. 4 — Pour Lock-Out

The autoladle having completed pouring metal to the transfer device ladle now sends a signal to the transfer device which energizes the autoladle pour lock-out control relay 20CR and 21CR. Pour signal control relay 19CR is now de-energized. The abort timer TD1 is now started. All other electrical functions remain the same as in preceding PM Left cycle — Step No. 3.

PM Left Cycle — Step No. 5 — Transfer Device Moving Counterclockwise

Fill Position control relay 2CR is now de-energized. The (Ladle Swing Reverse CCW) Relay is now energized causing the transfer device to start moving from the fill position to the PM Left position, opening transfer device in fill position cam switch CS1A. All other electrical functions remain the same as in preceding PM Left cycle — Step No. 4.

PM Left Cycle. Step No. 6 — Transfer Device at PM Left Position

In moving the transfer device closes transfer device at PM Left position cam switch CS2A. "Transfer device at PM Left position" control relay 3CR is also energized. In FIG. 13, a signal is sent to PM Left that the transfer device is at the PM Left position. The ladle approaching the in position will close CS6A energizing 39CR. 39CR controls the slow down approach.

PM Left Cycle — Step No. 7 — Transfer Device in PM Left Position

In rotating into the PM Left position, the transfer device in PM Left position limit switch 3LS is now closed. Transfer device in PM Left position control relay 4CR is now energized and the 26 CR Ladle Swing is now de-energized. Meanwhile in FIG. 14, a signal is received from PM Right that de-energized cooling cycle timer control relay 35CR. All other electrical functions remain the same as in preceding PM Left cycle — Step No. 6.

PM Left Cycle. Step No. 8 — Ladle Down

The ladle up control relay 11CR is now de-energized and the ladle down control relay 22CR is now energized. The ladle now moves down from the up position and the ladle up limit switch 1LS is now opened. Meanwhile in FIG. 14, a signal received from PM Right indicates that the molds are now opening and the mold halves closed control relay 34CR is now de-energized. All other electrical functions remain the same as in preceding PM Left cycle — Step No. 7.

PM Left Cycle. Step No. 9 — Ladle Fully Down

The closing of ladle down limit switch 2LS indicates that the ladle has now dropped into the fully down position for pouring. The ladle down control relay 12CR is now energized. Meanwhile in FIG. 14, a signal received from PM Right indicates that the unloader has left the discharge position to remove the castings poured in the PM Right cycle and this signal causes the "unloader over discharge" control relay control 54CR to be opened. All other electrical functions remain the same as in preceding PM Left cycle — Step No. 8.

PM Left Cycle. Step No. 10 — Ladle Motor Turning

Ladle Turn Forward control relay 13CR is now energized. The ladle motor starts turning causing the molds on PM Left to be poured with metal contained in the ladle. All other electrical functions remain the same as in the preceding PM Left cycle — Step No. 9.

PM Left Cycle. Step No. 11 — Ladle Motor Turning

In turning, the ladle leaves its horizontal position and the ladle horizontal cam switch CS1B is now opened. Opening of the cam switch results in ladle horizontal control relay 9CR being de-energized. The abort timer on timer TD1 is now also de-energized. In FIG. 14, an incoming signal from PM Right results in the closing of unloader over discharge control relay contact 54CR, while the ladle is turning CS3B and CS4B by energizing 36CR and 37CR select speed potentiometer to obtain required pouring speeds. 37CR energized 38CR which applies power to the skim catcher solenoid bringing the skim catcher forward. The skim catcher going forward will open 5LS and de-energize 42CR.

PM Left Cycle. Step No. 12 — Ladle Vertical

The ladle in turning has now poured the castings on PM Left and reaches a vertical position and closes the contact on ladle vertical limit switch CS2B. Ladle vertical control relay 10CR is now energized. The ladle turn reverse control relay 14CR is now energized and PM Left selector control relay 17CR is now de-energized and since the pouring of PM Left has now been completed, the autoladle pour lock-out control relay 20CR and 21CR is now de-energized, making it possible for the transfer device to be refilled when it reaches the fill position later in the cycle. In FIG. 12, the PM Left machine now goes into its cooling cycle, the molds having been poured. PM Left issues a signal and cooling cycle timer control relay 33CR is now energized. The transfer device at this stage issues a signal to PM Left to start the timer. The signal that has been going out to PM Left to keep the molds closed is now cancelled. Meanwhile, in FIG. 14, PM Right issues a signal to the transfer device that the loader is over the pick-up and opens loader over pick-up control relay control 62CR. All other electrical functions remain the same as in preceding PM Left cycle — Step No. 11.

PM Left Cycle. Step No. 13 — Ladle Return to Horizontal PM Right Pour Signal Lock As the ladle motor continues to turn, the ladle vertical cam siwtch CS2B is now re-opened. This causes the ladle vertical control relay 10CR to de-energize. In FIG. 13 the outgoing signal to start the timer in PM Left is discontinued. The PM Right pour signal lock-in control relay 16CR is now energized and the PM Left pour signal lock-in control relay 15CR is de-energized. All other electrical functions remain the same as in preceding PM Left cycle — Step No. 12.

PM Left Cycle — Step No. 14 — Ladle Horizontal — PM Right Selector

Ladle Horizontal cam switch CS1B is now closed as the ladle turns into the horizontal position. This results in the energizing of ladle horizontal control relay 9CR and the de-energizing of ladle Turn Rev. control relay 14CR. Control relay 10CR is now de-energized. The Ladle Up relay 23CR is now energized supplying power to the Ladle up speed drive causing the ladle to rise from the pouring position. The "PM Right selector" control relay 18CR is now energized indicating that the transfer device will next service PM Right. In FIG. 14, an incoming signal closes the loader over pick-up control relay contact 62CR, and a signal is sent to PM Right to close the molds. All other electrical functions remain the same as in preceding PM Left cycle — Step No. 13.

PM Left Cycle — Step No. 15 — Ladle up

The ladle moving into the up position closes the ladle up limit switch LS1 and opens the ladle down limit switch LS2. The ladle down control relay 12CR is now deenergized while the ladle up control relay 23CR is now energized. All other electrical functions remain the same as in preceding PM Left cycle — Step No. 14.

PM Left Cycle. Step No. 16 — Transfer Device Return to Fill Position

The Ladle Swing Forward CW Relay 25CR is now energized causing the transfer device to return to the fill position from PM Left. Meanwhile in FIG. 14, a signal coming in from PM Right energizes mold halves closed control relay 34CR. All other electrical functions as in preceding PM Left cycle — Step No. 15.

PM Left Cycle. Step No. 17 — Transfer Device Returning to Fill Position.

The transfer device in returning to the fill position opened the transfer device in PM Left Position limit switch 3LS and de-energizes the transfer device in PM Left position control relay 4CR. All other electrical functions remain the same as in preceding PM Left cycle — Step No. 16.

PM Left Cycle. Step No. 18 — Transfer Device Returning to Fill Position

Transfer device at P.M. Left Position limit switch 3LS is now opened and the transfer device at PM Left position control relay 3CR is now de-energized. The ladle swing forward approach control relay 25CR is now energized. In FIG. 12 the signal being sent to PM Left that the transfer device is at the PM Left position is cancelled. All other electrical functions remain the same as in preceding PM Left cycle — Step No. 17.

PM Left Cycle. Step No. 19 — Transfer Device in Fill Position

The transfer device in fill position cam switch CS1A is now closed signifying the arrival of the transfer device to the fill position. The corresponding fill position control relay 2CR is now energized. The clockwise rotation relay 25CR is de-energized with the return of the transfer device from the PM Left position so that rotational drive of the transfer device is discontinued. All other electrical functions remain the same as in preceding PM Left cycle — Step No. 18.

PM Left Cycle. Step No. 20 — Skim Catcher Return Brake on-off — PM Right cycle. Step No. 1 — Pour Ready The skim catcher solenoid is now de-energized bringing the skim catcher back. This will close 5LS and energize 42CR. The air brake solenoid will be energized after a delay of 1 ½seconds freeing the ladle.

Thus, PM Left cycle ends and the start of the next PM Right cycle occurs in this step by the energizing of the pour signal control relay 19CR. The system will now continue through a PM Right cycle and on reaching the final Step will be back at Step No. 1 of PM Left cycle. The system will continue to go through PM Left cycles and PM Right cycles alternately producing pistons in a completely automatic manner.

Having described the invention, what is claimed is:

1. An automatic ladle for pouring molten material comprising:

a pouring ladle, a substantially horizontal arm supporting the ladle at one end thereof for rotational movement between a substantially horizontal normal attitude for filling the ladle and a tilted attitude for pouring the metal from the ladle when the arm is rotated about its longitudinal axis, and rotating means operatively connected to the arm for rotating it about its longitudinal axis in a controlled manner whereby pouring from the ladle is accomplished, the rotating means including:

variable speed electric motor means operatively connected to the arm for rotating it, and electrical control means responsive to ladle-arm rotation and operatively connected to the motor means for controlling the speed of rotation thereof to provide pouring of the metal therefrom a variable controlled pour rates during pouring.

2. The automatic ladle according to claim 1 wherein the electrical control means comprises a rotary switch means.

3. The automatic ladle according to claim 2 wherein the rotary switch means includes rotary cam means and is driven in rotation along with the rotation of the arm whereby switches are closed at different intervals of the rotation to change the speed of the motor means in a programmed fashion.

4. The automatic ladle according to claim 3 wherein a driving chain means interconnects the rotary switch axis and the arm whereby rotation of the arm causes rotation of the rotary switch means and operation of the switches.

5. An automatic pouring apparatus comprising:

support means, a horizontally extending arm carried by the support means, the arm being mounted so as to be rotatable about its longitudinal axis and radially movable about the support means in an arcuate sweeping fashion;

a pouring ladle carried at the end of the arm and rotatable therewith whereby the arm may, by rotation about its longitudinal axis, move the ladle from a substantially horizontal attitude through a tilting motion to a pouring attitude;

arm rotating means for rotating the arm about its longitudinal axis, and means pivotally attaching the arm to the support means for radial movement about a vertical axis between at least two positions, namely a fill position and a pour position, variable speed motor means connected to the arm rotating means for rotating the arm about the longitudinal and vertical axes, and control means operatively connected to the variable speed motor means for initiating and controlling the movement of the arm.

6. The apparatus according to claim 5 wherein the support means includes:

upper and lower spaced table means, the arm being carried by the upper table means, the lower table being mounted for rotation of the arm radially, parallel linkage means interconnecting the two tables whereby the upper table may be moved toward and away from the lower table, the linkage including driving means for imparting movement to the linkage and the upper table.

7. The apparatus according to claim 6 wherein the linkage driving means comprises an electric motor and an output shaft operatively connected to actuate the linkage.

8. The apparatus according to claim 5 wherein the arm rotating means and the pivotal attachment means for radial movement include, respectively:

individual motor means and control means.

9. The apparatus according to claim 8 wherein the control means comprises rotary switch means driven by rotation of the arm about the longitudinal and vertical axes, and switch means being arranged to be opened and closed in programmed fashion for initiating and controlling the operation of the apparatus.

10. The apparatus according to claim 9 wherein the rotary switch means include rotary cam switches and driving means interconnects the rotary switch means with the axes for operation of the cam switch means thereof.

11. Automatic mold pouring apparatus comprising:

a horixontally extending arm means mounted so as to be rotatable about its longitudinal axis and radially movable in an arcuate sweeping fashion about a vertical axis;

a pouring ladle carried by the arm means and rotatable therewith whereby the arm means may, by rotation about its longitudinal axis, move the ladle from a substantially horizontal attitude through a tilting motion to a pouring attitude;

rotary switch means including a first plurality of switches arranged along a first switch axis of rotation whereby rotation about the first switch axis operates the switches in a predetermined sequential pattern to provide various control signals, electric motor means having a rotary output connected to both the arm means and rotary switch means for the simultaneous rotation of the arm means about its longitudinal axis and the rotary switch means about its axis.

12. The apparatus according to claim 11 including:

a second rotary switch means including a second plurality of switches arranged along a second axis of rotation whereby rotation about the second axis operates the second plurality of switches in a predetermined sequential pattern to provide various control signals, a second electric motor means having a rotary output connected to both the arm means and the second rotary switch means for the simultaneous rotation of the arm means about its vertical axis and the second rotary switch means about its axis.

13. The apparatus according to claim 11 including dross catching means and positioning means actuable when the ladle has poured for positioning the dross catching means in proximity to the ladle for catching the dross.

14. The apparatus according to claim 11 wherein the support means includes:

upper and lower spaced table means, the arm being carried by the upper table means, the lower table being mounted for rotation of the arm radially, parallel linkage means interconnecting the two tables whereby the upper table may be moved toward and away from the lower table, the linkage including driving means for imparting movement to the linkage and the upper table.

* * * * *